US006918650B2

(12) United States Patent
Umeda et al.

(10) Patent No.: US 6,918,650 B2
(45) Date of Patent: Jul. 19, 2005

(54) INKJET RECORDING APPARATUS, INK GUIDE MEMBER AND PURGE UNIT

(75) Inventors: Takaichiro Umeda, Nagoya (JP); Mikio Ogawa, Nagoya (JP); Hiroaki Yazawa, Nagoya (JP); Yukio Shiohara, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 59 days.

(21) Appl. No.: 10/626,560

(22) Filed: Jul. 25, 2003

(65) Prior Publication Data

US 2004/0155920 A1 Aug. 12, 2004

(30) Foreign Application Priority Data

Jul. 26, 2002 (JP) ..... 2002-218769
Mar. 26, 2003 (JP) ..... 2003-085199

(51) Int. Cl.[7] ..... B41J 2/165
(52) U.S. Cl. ..... 347/30; 347/29; 347/32
(58) Field of Search ..... 347/29, 30, 32, 347/33

(56) References Cited

U.S. PATENT DOCUMENTS 6,017,109 A 1/2000 Saijo
6,312,092 B1 11/2001 Usui et al.
6,540,322 B2 * 4/2003 Usui et al. ..... 347/29

FOREIGN PATENT DOCUMENTS

| | | |
|---|---|---|
| JP | 07-195712 | 8/1995 |
| JP | 10-264402 | 10/1998 |
| JP | A 2002-240325 | 8/2002 |

* cited by examiner

*Primary Examiner*—Shih-Wen Hsieh
(74) *Attorney, Agent, or Firm*—Oliff & Berridge, PLC

(57) ABSTRACT

In an inkjet recording apparatus, a suction channel is defined between a concave groove-like channel of an ink guide member and a cap member. An ink discharge port is open to the suction channel while the suction channel communicates with the atmosphere through a plurality of communication holes. The distance between a bottom surface of the cap member and a surface of the concave groove-like channel facing the bottom surface is reduced in accordance with the distance from the ink discharge port. The ink discharge port is entirely covered with one longitudinal end portion of the ink guide member. The horizontal sectional area of each communication hole increases in accordance with the distance from the ink discharge port.

28 Claims, 28 Drawing Sheets

[Related Art]

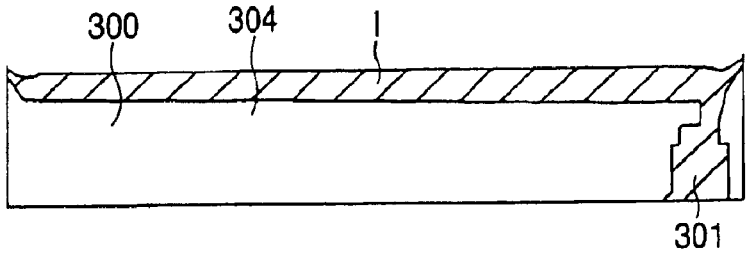
FIG. 23A [Related Art]
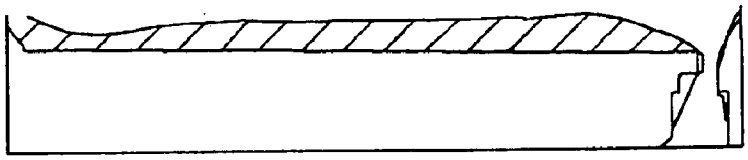
FIG. 23B [Related Art]
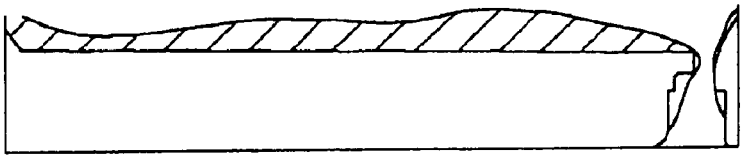
FIG. 23C [Related Art]
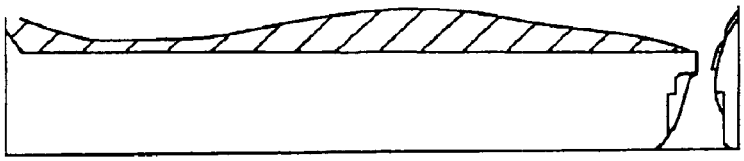
FIG. 23D [Related Art]
FIG. 23E [Related Art]
ANALYSIS CONDITIONS
| | | | |
|---|---|---|---|
| GENERATED NEGATIVE PRESSURE | -50 [kPa] | FLUID VISCOSITY | 3.0 [mPa·s] |
| CHIP HOLE NUMBER | 0 | FLUID SURFACE TENSION | 38.0 [mN/m] |
| CHIP HOLE POSITION | | FLUID DENSITY | 1000.0 [kg/m$^3$] |
| CHIP HOLE DIAMETER | | | |
| GAP BETWEEN CHIP AND CAP | 0 [mm] | | |
| CHIP THICKNESS | 1 [mm] | | |

FIG. 24E [Related Art]

ANALYSIS CONDITIONS

| | | | |
|---|---|---|---|
| GENERATED NEGATIVE PRESSURE | -50 [kPa] | FLUID VISCOSITY | 3.0 [mPa·s] |
| CHIP HOLE NUMBER | 7 | FLUID SURFACE TENSION | 38.0 [mN/m] |
| CHIP HOLE CENTER POSITION | 0.85 mm FROM RIGHT END SURFACE, AND SUBSEQUENTLY AT AN INTERVAL OF 4.33 mm | FLUID DENSITY | 1000.0 [kg/m$^3$] |
| CHIP HOLE DIAMETER | 0.6 [mm] UNIFORMLY | | |
| GAP BETWEEN CHIP AND CAP | 0.5 [mm] CONSTANTLY | | |
| CHIP THICKNESS | 1 [mm] | | |

FIG. 25A
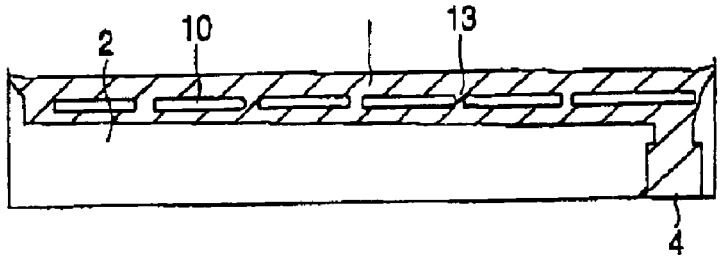
FIG. 25B
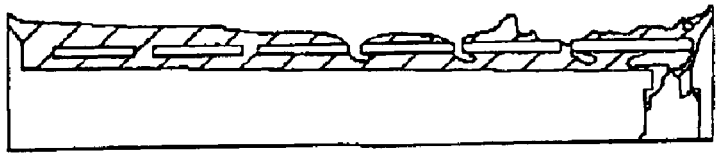
FIG. 25C
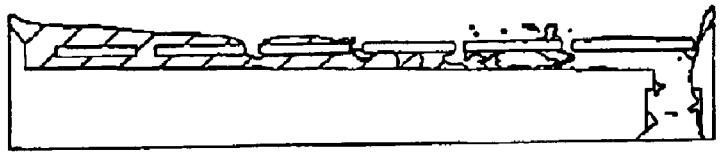
FIG. 25D
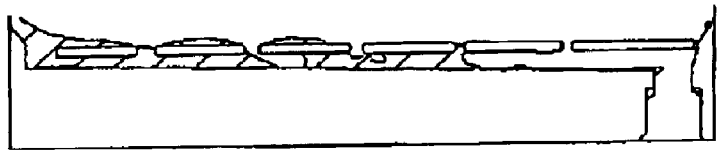
FIG. 25E
ANALYSIS CONDITIONS
| | | | |
|---|---|---|---|
| GENERATED NEGATIVE PRESSURE | -50 [kPa] | FLUID VISCOSITY | 3.0 [mPa·s] |
| CHIP HOLE NUMBER | 6 | FLUID SURFACE TENSION | 38.0 [mN/m] |
| CHIP HOLE CENTER POSITION | 5.18 mm FROM RIGHT END SURFACE, AND SUBSEQUENTLY AT AN INTERVAL OF 4.33 mm | FLUID DENSITY | 1000.0 [kg/m$^3$] |
| CHIP HOLE DIAMETER | 0.4, 0.4, 0.5, 0.6, 0.7 AND 1.4 [mm] FROM RIGHT | | |
| GAP BETWEEN CHIP AND CAP | 0.5 [mm] IN LEFT END, 1 [mm] IN RIGHT END | | |
| CHIP THICKNESS | 1 [mm] | | |

INKJET RECORDING APPARATUS, INK GUIDE MEMBER AND PURGE UNIT

BACKGROUND OF THE INVENTION

1. Field of the Invention

The present invention relates to an ink jet recording apparatus, an ink guide member in the inkjet recording apparatus, a suction cap engaged with the ink guide member, and a purge unit having the suction cap.

2. Description of the Related Art

Conventionally, there is known an inkjet recording apparatus that jets out ink from an inkjet head to thereby conduct printing. A large number of nozzles for jetting ink are formed in the inkjet head. Due to bubbles or dust entering the inside of a nozzle or due to the viscosity of the ink increased by evaporation of an ink solvent, there is a case in which the ink is not jetted from the nozzle or the jetting state of the ink is not suitable for recording. Therefore, an ink jet recovery process is carried out to remove such factors in failure in ink jet.

As a unit for carrying out such an ink jet recovery process, there is provided a unit including a cap capable of covering the nozzle opening surface of the inkjet head and a suction pump communicating with the cap and making suction power act thereon. The suction pump is driven in the state where the nozzle opening surface has been covered with the cap. Thus, ink is discharged from the nozzles forcibly so that the factors in failure in ink jet are removed together with the ink.

After the cap is released from the covering state, the ink received by the cap in the ink jet recovery process is discharged from the cap by the effect of suction power applied again, and introduced into a waste ink tank through the suction pump. In this situation, due to the improper configuration of the cap or the like, the received ink that cannot be discharged perfectly from the cap may remain therein.

When the ink remains in the cap, the ink may leak into the apparatus for some reason, or the ink may be solidified in the cap to thereby deteriorate the cap performance conspicuously. Further, the nozzle opening surface may be covered with the cap while recording is not conducted. When the cap serves as a conservative cap in such a manner, residual ink adheres to the nozzle opening surface when the nozzle opening is covered with the cap. Thus, there may occur a failure in ink jet such that the direction of ink jet from the nozzles is shifted from a predetermined direction.

To solve such problems, the shape of the cap has been hitherto devised. FIG. 35 is a longitudinal sectional view showing an example of a cap in the related art. The bottom surface of a concave portion 80*a* of a cap 80 is formed of a slope 82 inclined to an ink discharge port 81 as shown in FIG. 35, in order to discharge ink received by the cap efficiently.

However, in the related art configuration as shown in FIG. 35, of the ink in the concave portion 80*a*, only the ink just above the ink discharge port 81 is apt to be sucked immediately while the ink far from the ink discharge port 81 is left.

SUMMARY OF THE INVENTION

The present invention has been made to solve the above problems, and therefore an object of the present invention is to provide an inkjet recording apparatus having a cap configuration to prevent ink from remaining in the cap without complicating the manufacturing process.

According to an aspect of the invention, there is provided an inkjet recording apparatus including: a print head having a plurality of inkjet ports; a suction cap which seals up the inkjet ports to carry out ink suction, the suction cap having an ink discharge port for discharging ink received through the ink suction; and an ink guide member which is engageable into the suction cap, the ink guide member having a channel of predetermined length, wherein the channel constitutes a suction channel between the channel and the suction cap when the ink guide member is engaged into the suction cap, the suction channel communicating with the ink discharge port.

According to the inkjet recording apparatus thus configured, a suction channel is defined between the ink guide member and the suction cap by the ink guide member. In idle suction of ink after purge suction, ink can be sucked and discharged forcibly from the ink discharge port open to the suction channel. Thus, the idle suction of ink can be performed efficiently without inclining the bottom surface in the suction cap. As a result, the height of the suction cap can be kept to a minimum. Thus, the purge unit and hence the inkjet recording apparatus as a whole can be made thinner.

According to another aspect of the invention, there is provided an inkjet recording apparatus including; a recording head for jetting ink from ink nozzles to conduct recording on a recording medium; a cap having a sealing portion for sealing up the ink nozzles and an ink discharge port for sucking and discharging ink received from the recording head by means of negative pressure, the sealing portion having a bottom surface; and an ink guide member which is placable in the sealing portion oppositely to the bottom surface of the sealing portion, wherein a distance between the bottom surface of the sealing portion and the ink guide member is set to be larger in an area near the ink discharge port than in an area distant from the ink discharge port when the ink guide member is placed in the cap.

With such a configuration, the distance between the bottom surface of the sealing portion and the ink guide member is larger in an area near the ink discharge port than in an area distant from the ink discharge port. With the increase of the distance, the channel of ink between a position far from the ink discharge port and the ink discharge port is widened.

BRIEF DESCRIPTION OF THE DRAWINGS

These and other objects and advantages of this invention will become more fully apparent from the following detailed description taken with the accompanying drawings in which:

FIGS. 23A to 23E show a simulation of an ink flow in a suction cap;

FIGS. 24A to 24E show a simulation of an ink flow in a suction cap;

FIGS. 25A to 25E show a simulation of an ink flow in a suction cap;

DETAILED DESCRIPTION OF THE PREFERRED EMBODIMENTS

An embodiment of the invention will be described below with reference to the accompanying drawings.

This embodiment is directed to a multifunctional apparatus having a telephone function, etc., in addition to a printer function, a copier function, a scanner function, and a facsimile function.

Figure 11:
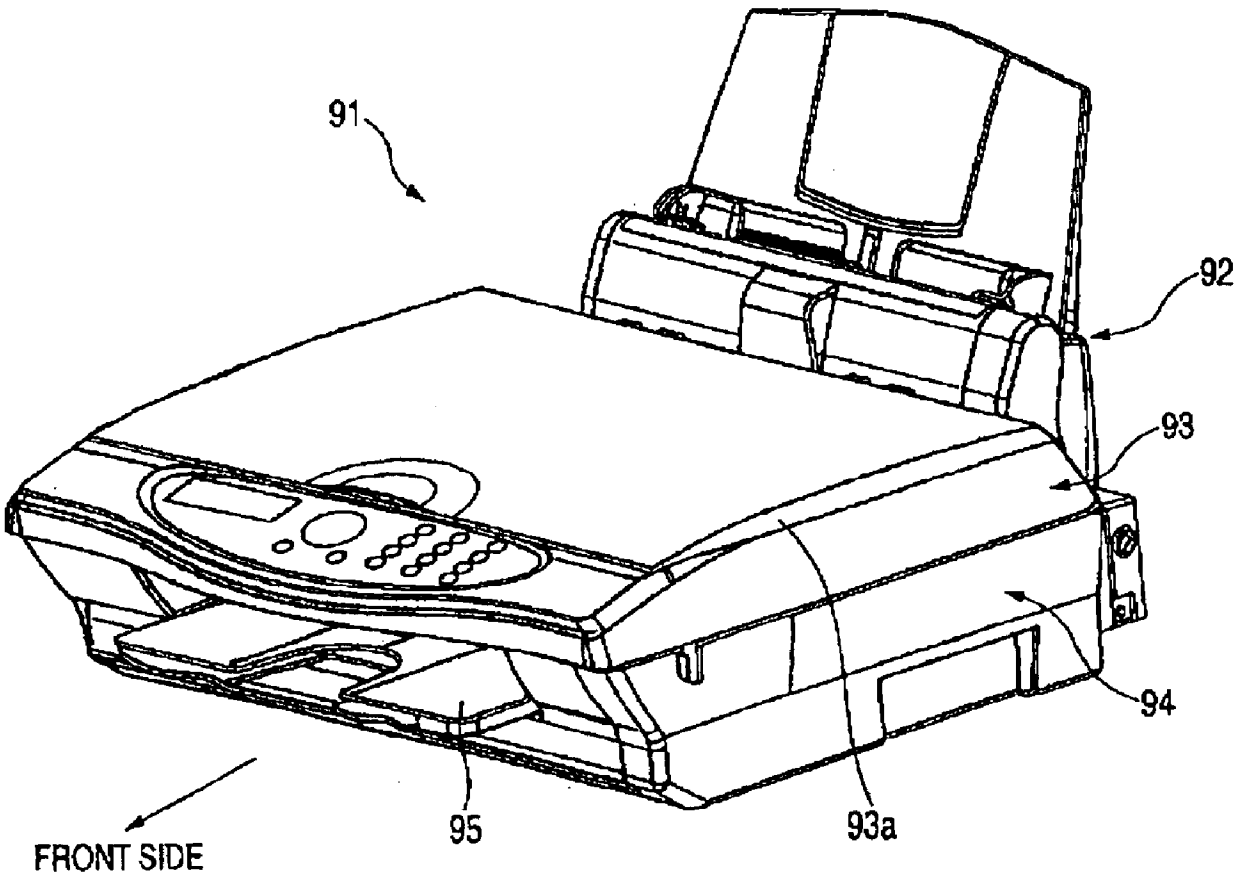
FIG. 11 is a perspective view showing an embodiment of an inkjet recording apparatus according to the invention.

As shown in FIG. 11, a multifunctional apparatus 91 is equipped with a sheet feeder 92 on a back side thereof. A document reading device 93 for the copier function (scanner function) and the facsimile function is disposed so as to occupy a top portion of a section in front of the sheet feeder 92. An ink jet printer 94 (inkjet recording apparatus) as an implementation of the printer function is disposed so as to occupy the entire portion under the document reading device 93. A table 95 for ejection of printed sheets is disposed in front of the ink jet printer 94.

The document reading device 93 is structured as follows (not shown in FIG. 1). The document reading device 93 can be swung vertically around a horizontal axis that is located at the rear end. If a top cover 93*a* is opened upward, a user can see a document placement glass plate. An image scanning device for document reading is disposed under the glass plate. By opening the document reading device 93 upward by hand, the user can replace ink cartridges of the ink jet printer 94 or maintain a print mechanism section.

First Embodiment

Figure 1:
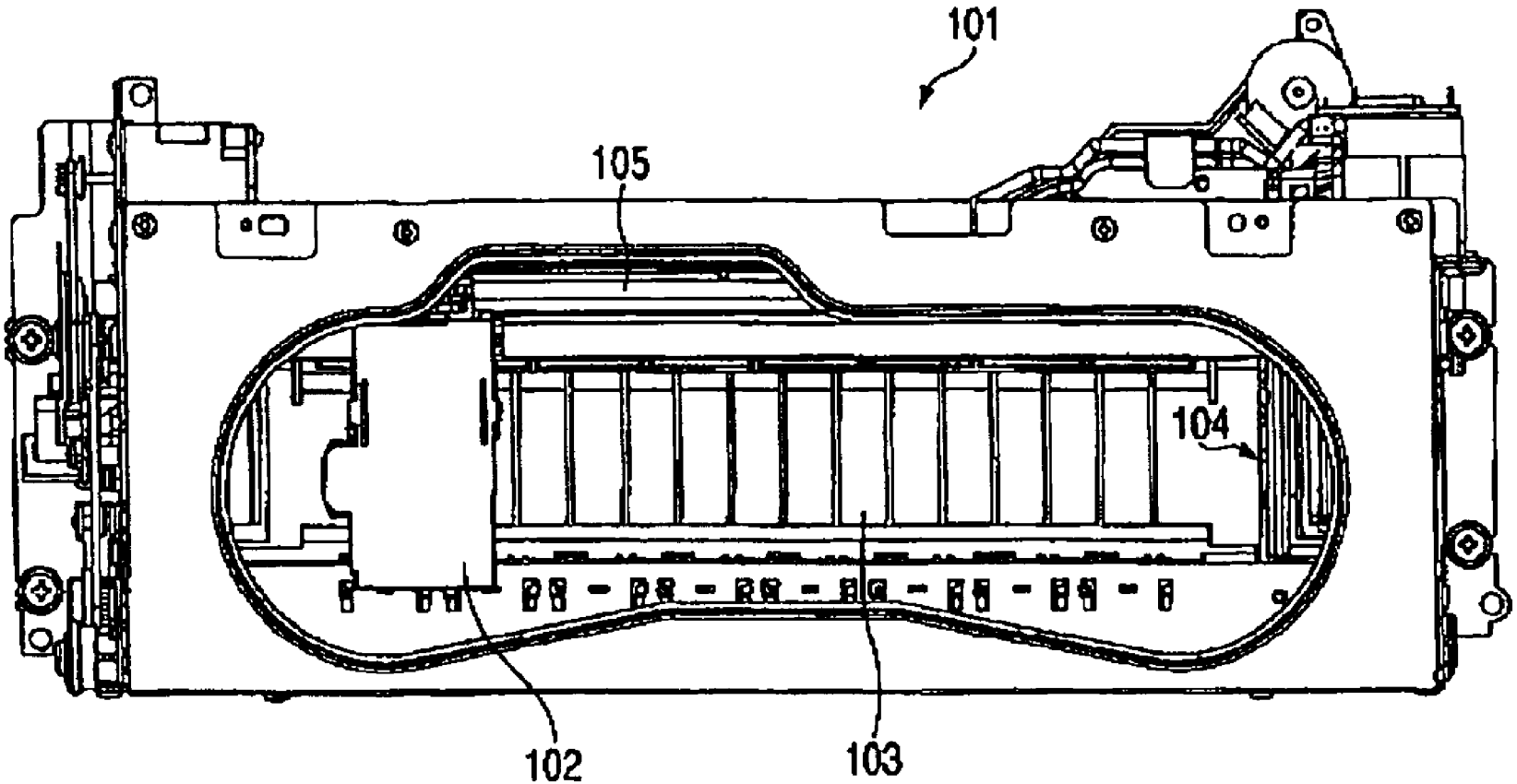
FIG. 1 is a plan view showing a print unit of an inkjet recording apparatus with a purge unit according to an embodiment of the invention.

FIG. 1 is a plan view of a print unit 101 of an inkjet recording apparatus having a purge unit according to the invention. In FIG. 1, the print unit 101 includes a carriage 102, a platen 103 with a rib, and a purge unit 104. The carriage 102 is mounted with a not-shown print head for jetting ink and conducting recording on a recording medium. The recording medium is picked up from a not-shown paper feed tray and carried to the platen 103. The platen 103 keeps the recording medium flat relatively to the print head. The purge unit 104 recovers the jetting conditions of inkjet ports of the print head. The recording medium on which recording has been finished is discharged from the print unit 101 by a not-shown discharge roller.

The carriage 102 is supported slidably along a horizontal guide shaft 105, and driven by a not-shown carriage motor so as to conduct recording while reciprocating. The purge unit 104 according to the invention is disposed to be lateral to one movable end of the carriage 102.

The schematic configuration of the purge unit 104 will be described with reference to FIGS. 2 and 3.

Figure 2:
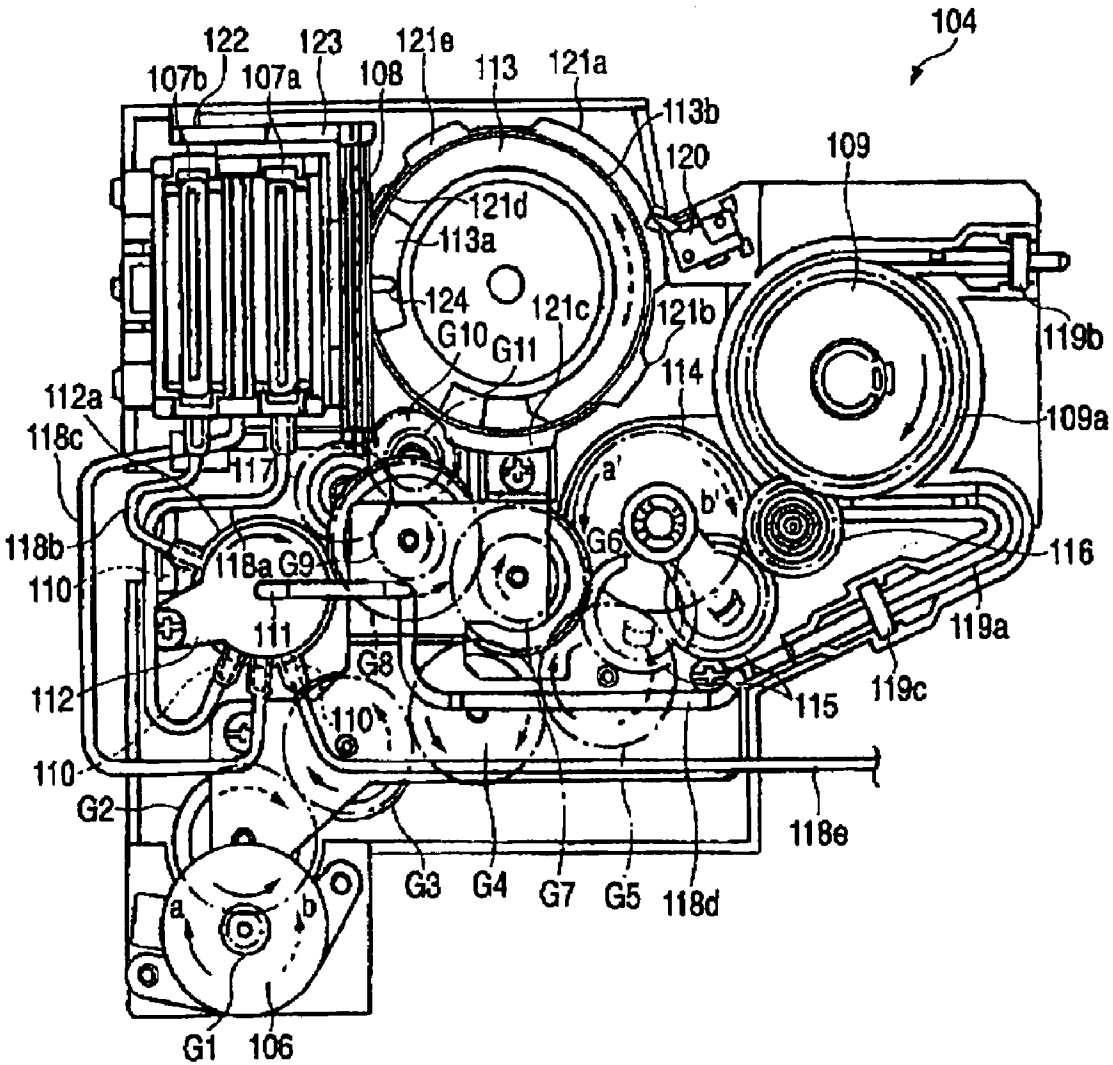
FIG. 2 is a plan view of the purge unit.
Figure 3:
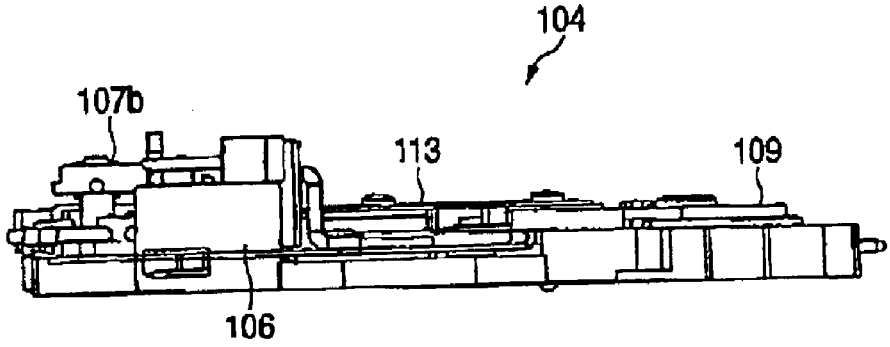
FIG. 3 is a side view of the purge unit.

FIG. 2 is a plan view of the purge unit 104, and FIG. 3 is a side view of the purge unit 104. The purge unit 104 shown in FIGS. 2 and 3 includes a motor 106, two suction caps 107*a* and 107*b*, a wiper 108, a suction pump 109, a changeover mechanism 112 and a cam 113. The motor 106 serves as a drive source. The inkjet port portion of the print head is covered from below with the suction caps 107*a* and 107*b*. The wiper 108 is provided for wiping the inkjet ports after purge suction and idle suction. The suction pump 109 is provided for sucking ink. The changeover mechanism 112 has suction ports 110 communicating with the suction caps 107*a* and 107*b*, the wiper 108 and a not-shown ink reservoir portion respectively, and an ejection port 111 communicating with the suction pump 109. The cam 113 is provided for driving and controlling the changeover mechanism 112. The motor 106, the suction pump 109, the changeover mechanism 112 and the cam 113 are linked through a plurality of gears G1 to G11 and 114 to 117.

The two suction caps 107*a* and 107*b* are provided separately to avoid mixture of colors of ink. The suction caps 107*a* and 107*b* are urged upward by not-shown springs while being connected to the suction ports 110 of the changeover mechanism 112 through tubes 118*a* and 118*b* respectively. The wiper 108 is connected to one of the suction ports 110 of the changeover mechanism 112 through a tube 118*c*.

The suction pump 109 is a tube-type pump. One end (ejection port) of a suction pump tube 119*a* connected to the suction pump 109 is coupled with a waste ink reservoir portion (not shown) through a tube connector 119*b* and a not-shown tube, while the other end (suction port) of the suction pump tube 119*a* is coupled with the ejection port 111 of the changeover mechanism 112 through a tube connector 119*c* and a tube 118*d*.

The suction pump tube 119*a* is attached into a tube groove in a pump case, and provided with a not-shown pressure roller in contact therewith. As soon as negative pressure occurs, the pressure roller squashes the suction pump tube 119*a* with the rotation of the suction pump 109. Accordingly, ink is sucked from the changeover mechanism 112 through the tube 118*d* due to negative pressure generated by the change in volume of the squashed suction pump tube 119*a*. The sucked ink is sent to the waste ink reservoir portion through a not-shown tube, and reserved therein.

On the other hand, not-shown cams are provided in the bottom surface of the cam 113 while a cam surface 113*a* and a plurality of convex cam surfaces 121*a* to 121*e* are provided in the outer circumference of the cam 113. The cams in the bottom surface are driven simultaneously and interlocking with the changeover mechanism 112 for vertically moving (capping/uncapping) the suction caps 107*a* and 107*b* relatively to the print head. On the other hand, the cam surface 113*a* moves the wiper 108 vertically. The cam surfaces 121*a* to 121*e* are brought into contact with a leaf switch 120 so as to turn the leaf switch 120 on/off. The leaf switch 120 is provided for detecting the rotation position of the cam 113.

The wiper 108 is attached to a link 123 swingable around a shaft 122 so that the wiper 108 can move vertically. The wiper 108 is always urged downward so as to retract downward not to contact with the inkjet ports of the print head all the times but wiping operation time. A pin 124 is provided in the link 123 so as to protrude therefrom. When the pin 124 is lifted up by the cam surface 113*a* at the wiping operation time, the wiper 108 is moved up and disposed in a position where the wiper 108 can contact with the inkjet ports of the print head.

Figure 34:
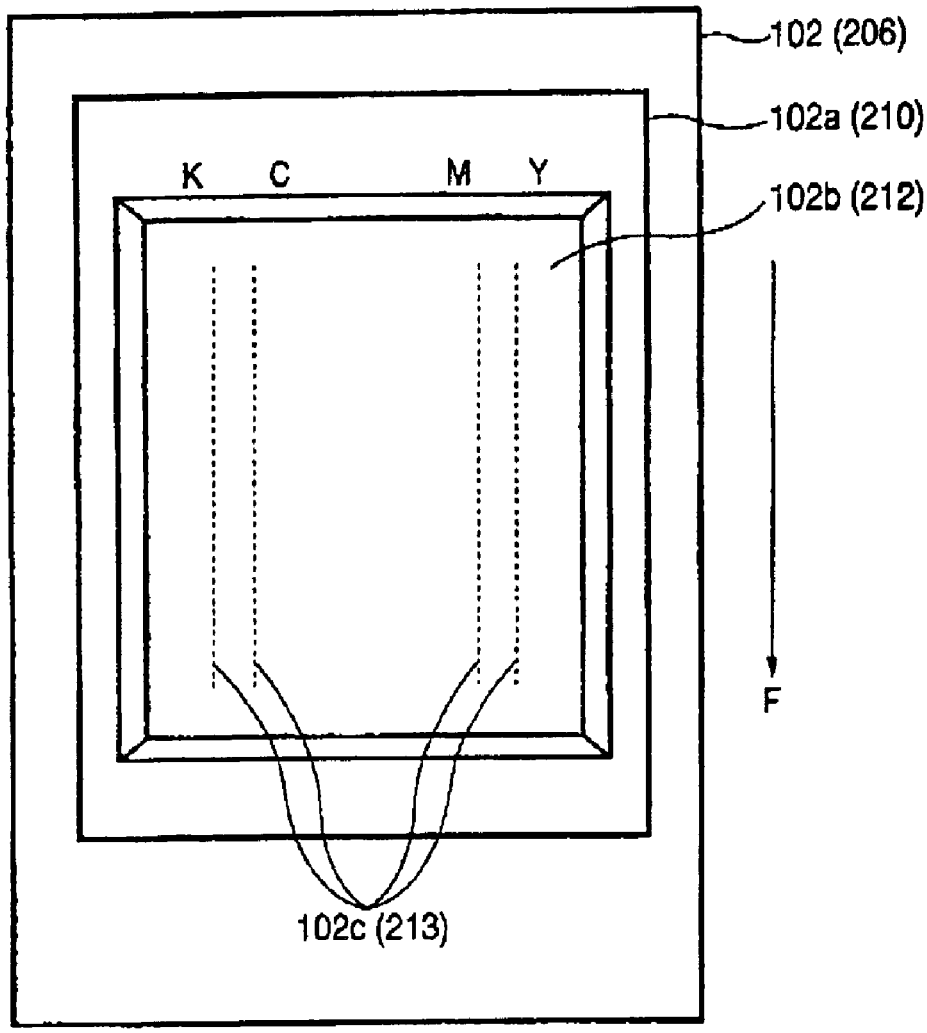
FIG. 34 is a schematic view showing a print head.
Figure 35:
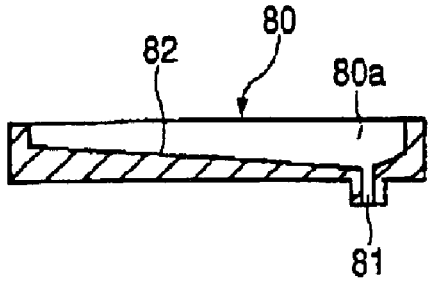
FIG. 35 is a longitudinal sectional view showing an example of a cap in the related art.

FIG. 34 is a schematic view showing the print head. The print head 102*a* is disposed on the carriage 102. The print head. 102*a* has a nozzle plate 102*b* in which a plurality of inkjet ports (ink nozzles) for jetting ink toward the platen 103 are formed correspondingly to four colors of Y (yellow), M (magenta), C (cyan) and K (black). The inkjet ports are formed in four arrays 102*c* parallel to a paper transporting direction F that is perpendicular to reciprocating direction of the carriage 102. The black nozzle array and the cyan nozzle array are disposed close to each other and the magenta nozzle array and the yellow nozzle array are disposed close to each other. Each of the suction caps 107*a* and 107*b* shown in FIG. 2 simultaneously cover two nozzle arrays disposed close to each other.

The inkjet recording apparatus shown in FIGS. 1 to 3 has the same configuration with that of the multifunctional apparatus 91 shown in FIG. 11.

Subsequently, the details of the configuration of the suction cap 107*a*, 107*b* according to the invention will be described with reference to FIGS. 4 to 7. Incidentally, the two suction caps 107*a* and 107*b* have quite the same configuration. Therefore, the following illustration and description will be made on only one cap 107*a*.

Figure 4:
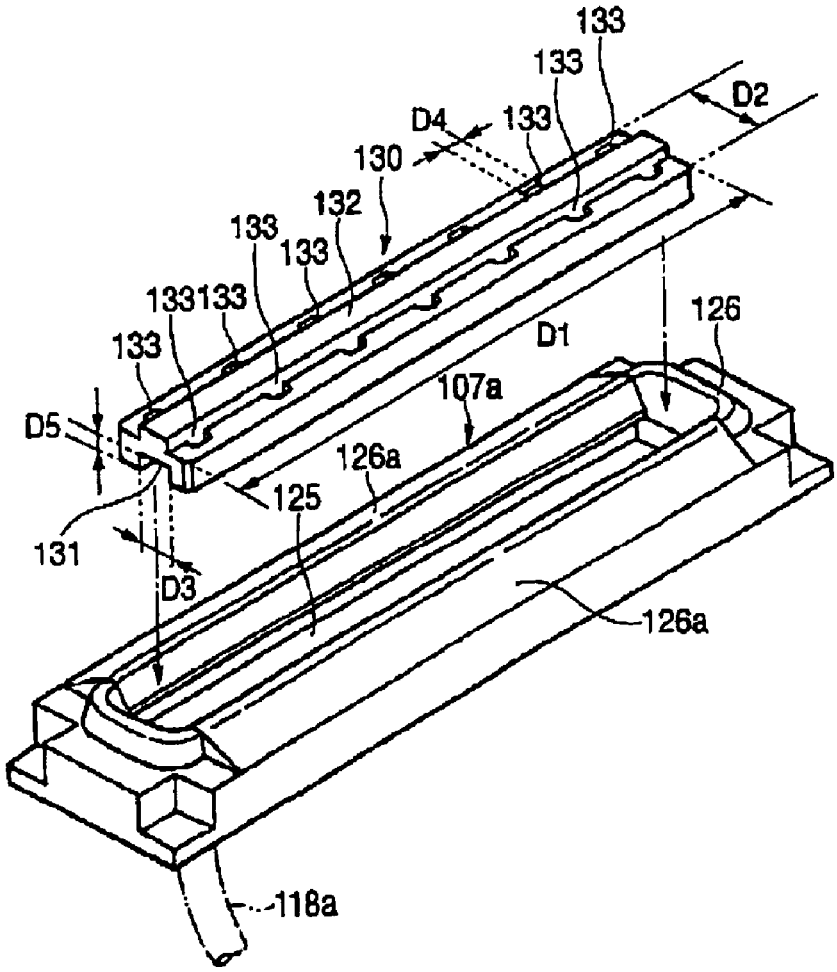
FIG. 4 is an exploded perspective view of a suction cap.
Figure 5:
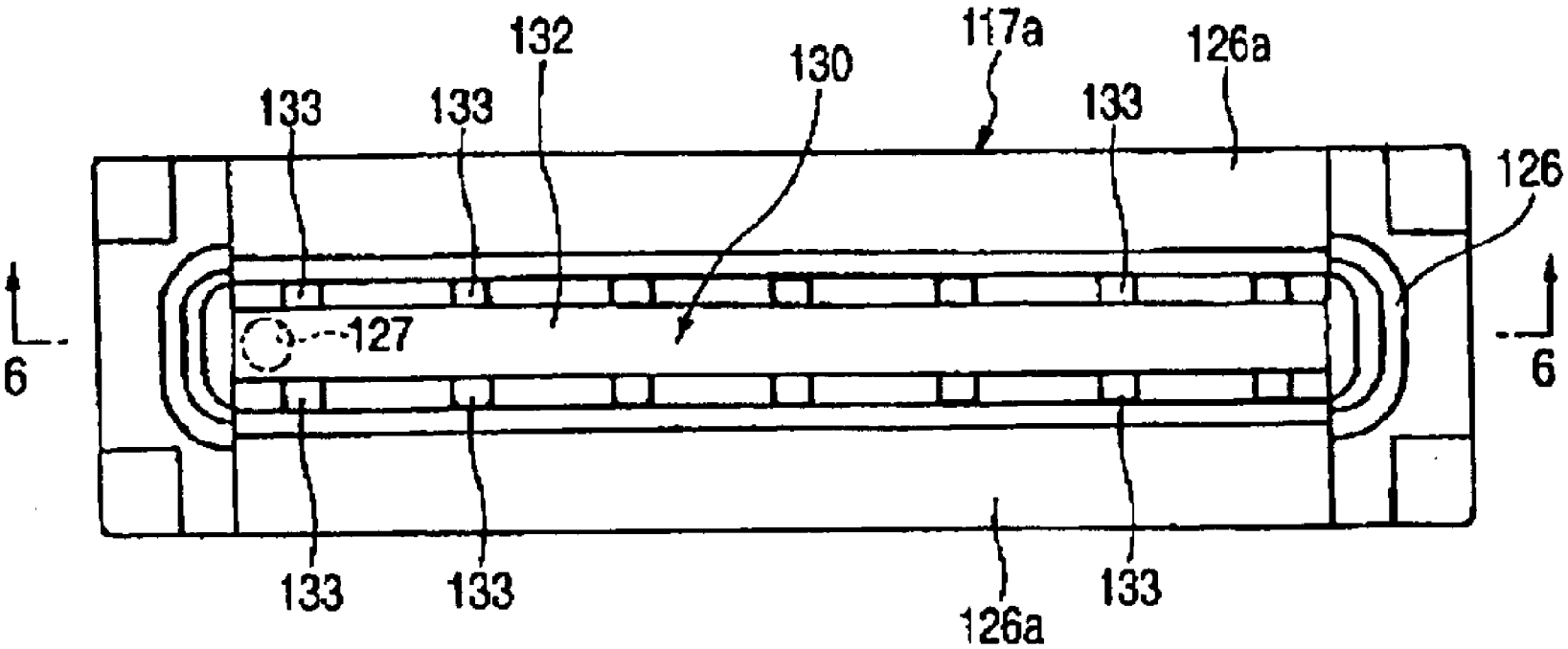
FIG. 5 is a plan view of the suction cap.
Figure 6:
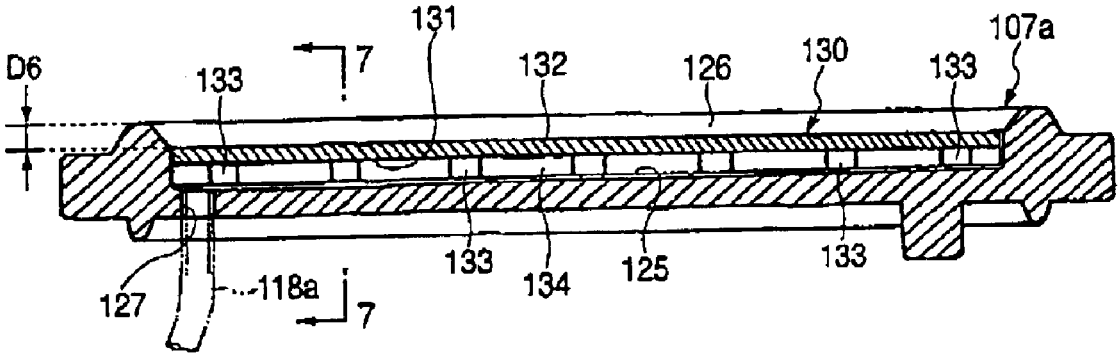
FIG. 6 is a sectional view taken along line 6—6 in FIG. 5.
Figure 7:
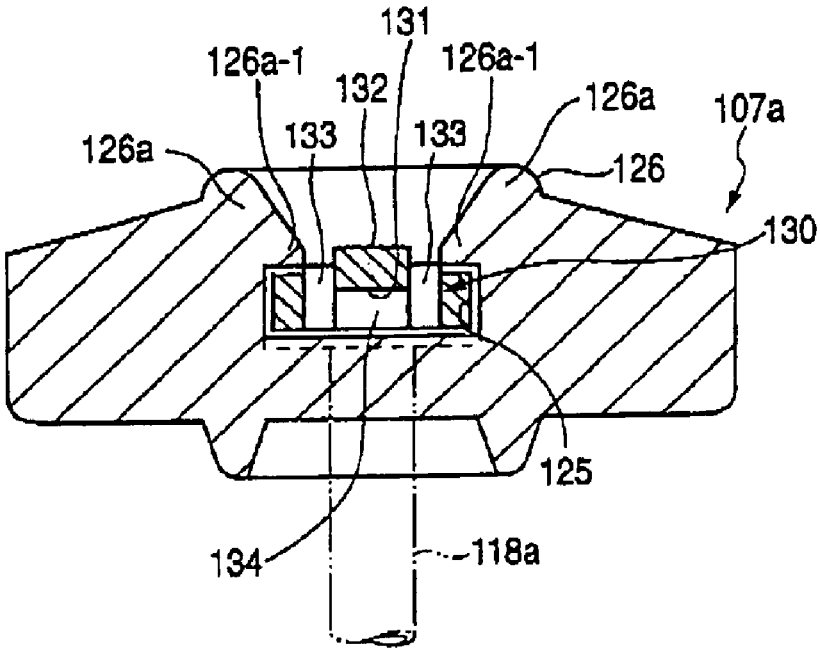
FIG. 7 is a sectional view taken along line 7—7 in FIG. 6.

FIG. 4 is an exploded perspective view of the suction cap; FIG. 5 is a plan view of the same suction cap; FIG. 6 is a sectional view taken along line 6—6 in FIG. 5; and FIG. 7 is a sectional view taken along line 7—7 in FIG. 6.

The suction cap 107*a* is molded into a substantially rectangular shape out of an elastic body of rubber or the like. A rectangular concave portion 125 is formed in the top surface of the suction cap 107*a*. The concave portion 125 is surrounded by a rectangular frame-like raised portion 126. A pair of opposite long sides of the raised portion 126 constitute engagement portions 126*a*, and an engagement claw is formed integrally with the free end edge of each engagement portion 126*a* as shown in FIG. 7.

As shown in FIG. 6, the bottom surface of the concave portion 125 formed in the top surface of the suction cap 107*a* forms a flat horizontal plane, which is not inclined as in the related art. A circular hole-like ink discharge port 127 is provided vertically in one end of the bottom surface of the concave portion 125 so as to penetrate the bottom surface as shown in FIGS. 5 and 6. The ink discharge portion 127 is connected to the suction port 110 of the changeover mechanism 112 shown in FIG. 2 through the tube 118*a*.

An ink guide member 130 according to the invention is fitted into the suction cap 107*a* so as to cover the concave portion 125 of the suction cap 107*a* from above as shown in FIG. 4. The left and right sides of the top surface of the ink guide member 130 are locked by engagement claws 126*a–1* of the left and right engagement portions 126*a* of the suction cap 107*a* as shown in FIG. 7. Thus, the ink guide member 130 is incorporated in the suction cap 107*a*.

The ink guide member 130 is molded into a substantially rectangular column-like shape out of resin (made of POM (Polyoxymethylene), PP (Polypropylene) or the like in this embodiment) hard to suffer erosion due to ink. A concave groove-like channel 131 having a rectangular shape in section and having a predetermined length is provided at the width-direction center of the bottom surface of the ink guide member 130 so as to penetrate the bottom surface in the length direction. A rectangular column-like reinforcing rib 132 is provided integrally with the width-direction center of the top surface of the ink guide member 130 so as to rise in the length direction on the opposite sides of the reinforcing rib 32 of the ink guide member 130, a plurality of (7 on each side in this embodiment) communication holes 133 are provided vertically at intervals of a regular pitch with respect to the length direction so as to penetrate the ink guide member 130. Specifically, as shown in FIG. 4, the length D1 of the ink guide member 130 is about 15–40 mm; the width D2 of the ink-guide member 130, about 1.5–5.0 mm; the width D3 of the concave groove-like channel 131, about 0.5–2.0 mm; the height D5 of the concave groove-like channel 131, about 0.3–1.0 mm; and the width D4 of each communication hole 133, about 0.3–1.0 mm.

In a state where the ink guide member 130 has been fitted into the suction cap 107*a* and locked therein as described above, a suction channel 134 is defined between the concave groove-like channel 131 of the ink guide member 130 and the suction cap 107*a* as shown in FIGS. 6 and 7. The ink discharge port 127 is open to the suction channel 134 while the suction channel 134 communicates with the atmosphere through the plurality of communication holes 133. In this case, the distance D6 between the highest surface of the ink guide member 130 and the highest surface of the raised portion 126 of the suction cap 107*a* is about 0.5–1.5 mm. In addition, the gap between the ink guide member 130 and the suction cap 107*a* is 0.1–0.3 mm, and ink will enter this gap.

In such a manner, the suction cap 107*a* is designed to have the ink guide member 130 incorporated therein. The operation of the purge unit 104 having the suction cap 107*a* and the suction cap 107*b* designed in the same manner as the suction cap 107*a* will be described below with reference to FIG. 2.

As shown in FIG. 2, the state where the leaf switch 120 has been put on the cam surface 121*a* is a reserved state of the print head. In this reserved state, the suction caps 107*a* and 107*b* move up to cover and seal up the inkjet ports of the print head.

When the motor 106 is driven to rotate in the arrow b direction in FIG. 2, the rotation is transmitted to the gear 114 through the gears G1 to G5 so that the gear 114 rotates in the illustrated arrow b' direction. As a result, the pendular gear (planet gear) 115 swings as shown by the chain line in FIG. 2 so as to mesh with the gear G6. The rotation of the pendular gear 115 is transmitted to a changeover member 112*a* of the changeover mechanism 112 through the gears G6 to G11 and the changeover idle gear 117, and also transmitted to the cam 113 through the gear G10 and a cam gear 113*b* meshing therewith. Thus, the changeover member 112*a* and the cam 113 are driven to rotate. In this state, the leaf switch 120 reaches the position where the leaf switch 120 has got off the cam surface 121*a,* so that negative pressure can be once accumulated in the tube 118*d* in order to suck ink from the suction cap 107*a*.

When the motor 106 is driven to rotate in the illustrated arrow a direction in this state, the gear 114 rotates in the arrow a direction, and the rotation of the gear 114 is transmitted to the pendular gear 115 meshing with the gear 114. Thus, the pendular gear 115 is driven to rotate so as to mesh with the gear 116. The rotation of the pendular gear 115 is transmitted to a pump gear 109*a* through the gear 116 so as to drive the suction pump 109.

Then, the motor 106 is driven to rotate in the illustrated arrow b direction again. When the leaf switch 120 reaches the position where the leaf switch 120 is put on the cam surface 121*b,* the changeover mechanism 112 communicates with one suction cap 107*a* through the tube 118*a* so that the negative pressure accumulated previously is released. Thus, ink is purge-sucked from the inkjet ports of the print head. The purge-sucked ink flows into the suction channel 134 through the plurality of communication holes 133 of the ink guide member 130 incorporated in the suction cap 107*a*. The ink reaching the changeover mechanism 112 through the tube 118*a* from the ink discharge port 127 open to the suction channel 134 is sent from the changeover mechanism 112 to a not-shown ink reservoir portion through the tube 118*e* and reserved therein.

Subsequently, the leaf switch 120 reaches the position where the leaf switch 120 has got off the cam surface 121*b,* so that negative pressure can be accumulated in the tube 118*d* in order to purge-suck ink from the other suction cap 107*b*. The suction pump 109 is driven in this state so as to accumulate negative pressure in the tube 118*d*.

After that, when the leaf switch 120 reaches the position where the leaf switch 120 has been put on the cam surface 121*c,* the changeover mechanism 112 communicates with the other suction cap 107*b* through the tube 118*b* so that the negative pressure accumulated previously is released. Thus, ink is purge-sucked from the inkjet ports of the print head. The purge-sucked ink flows into the not-shown ink reservoir portion through the tube 118*e* and reserved therein in the same manner as described previously.

When the purge suction of ink is performed in such a manner, both the suction caps 107*a* and 107*b* interlock with the motion of the cam 113 and move down against the urging force of the springs. Thus, the suction caps 107*a* and 107*b* are detached from the print head.

Subsequently, when the leaf switch 120 reaches the position where the leaf switch 120 has got off the cam surface 121*c,* the changeover mechanism 112 communicates with the suction cap 107*b* through the tube 118*b*. Thus, the suction pump 109 is driven to idle-suck the ink remaining in the suction cap 107*b*.

Then, when the leaf switch 120 reaches the position where the leaf switch 120 has been put on the cam surface 121*d,* the changeover mechanism 112 communicates with the suction cap 107*a* through the tube 118*a*. Thus, the suction pump 109 is driven to idle-suck the ink remaining in the suction cap 107*a*. Incidentally, the idle-sucked ink is sent to the ink reservoir portion through the tube 118*e* and reserved therein in the same manner as the purge-sucked ink.

Thus, in the idle suction, the suction channel 134 is defined between the suction caps 107*a* and 107*b* by the ink guide members 130 incorporated in the suction caps 107*a* and 107*b* so that ink can be sucked and discharged forcibly from the ink discharge port 127 open to the suction channel 134. It is therefore unnecessary to incline the bottom surface of the concave portion 125 of the suction cap 107*a,* 107*b* as in the related art, but it is possible to perform the idle suction of ink efficiently. As a result, the height of the suction cap 107*a,* 107*b* can be kept to a minimum, and the purge unit 104, hence the print unit 101 and further the inkjet recording apparatus as a whole can be made thinner.

In addition, the suction channel 134 defined in the suction cap 107*a,* 107*b* communicates with the atmosphere through the plurality of communication holes 133. Thus, the ink remaining in the suction cap 107*a,* 107*b* is sucked into the ink discharge port and discharged therefrom efficiently together with the air flowing into the suction channel 134 through the communication holes 133.

Moreover, according to this embodiment, the reinforcing rib 132 is provided in the width-direction central portion of the top surface of the ink guide member 130 so as to rise along the length direction. Accordingly, the strength and rigidity of the ink guide member 130 are enhanced by the reinforcing rib 132. Thus, failure such as damage of the ink guide member 130 does not occur in spite of the plurality of communication holes 133 formed on the opposite sides of the reinforcing rib 132.

Subsequently, when the leaf switch 120 reaches the position where the leaf switch 120 has got off the cat surface 121*d,* the changeover mechanism 112 communicates with the not-shown ink reservoir portion through the tube 118*e*. Accordingly, the ink reserved in the ink reservoir portion due to the purge suction and the idle suction conducted is then sucked. After that, both the suction caps 107*a* and 107*b* move down further with the rotation of the cam 113.

When the leaf switch 120 reaches the position where the leaf switch 120 has been put on the cam surface 121*e,* the changeover mechanism 112 communicates with the wiper 108 through the tube 118*c*. Accordingly, the ink reserved in the wiper 108 due to the wiping operation conducted is then sucked. After that, both the suction caps 107*a* and 107*b* move down further with the rotation of the cam 113, reaching their lower limit positions (uncapping positions). When the pin 124 is lifted up in that state by the cam surface 113*a* of the cam 113 as described previously, the wiper 108 moves upward, reaching the position where the wiper 108 can contact with the inkjet ports of the print head. When the carriage 102 is moved for printing operation in that state, the ink adhering to the inkjet ports of the print head can be wiped by suction operation. Thus, a series of steps of the purging process is completed so that the jetting conditions of the inkjet ports of the print head can be recovered.

Figure 8:
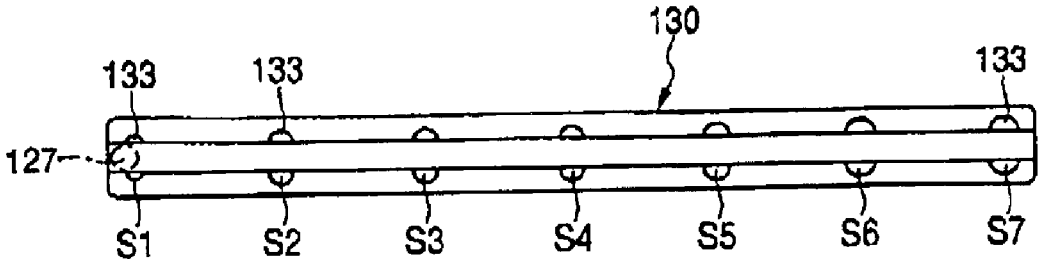
FIG. 8 is a plan view showing another embodiment of an ink guide member according to the invention.
Figure 9:
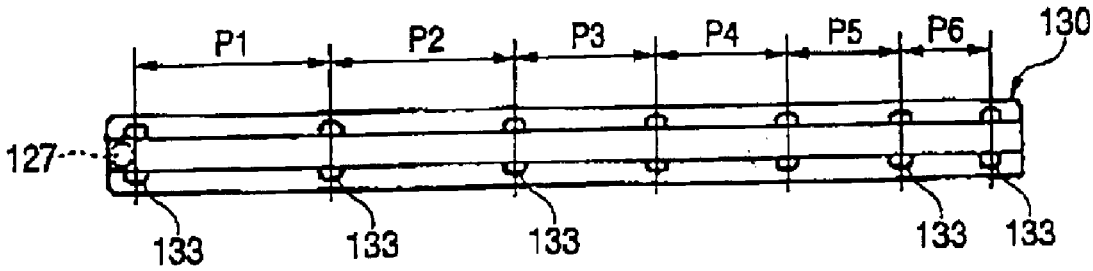
FIG. 9 is a plan view showing another embodiment of an ink guide member according to the invention.

A plurality of communication holes 133 each having the same dimensions (sectional area) are formed at intervals of a regular pitch in the ink guide member 130 in this embodiment. In the suction cap 101*a,* 107*b,* however, the suction power becomes lower in a place farther from the ink discharge port 127. Therefore, the sectional area S1–S7 of each communication hole 133 may be set to increase (that is, S1<S2<S3<S4<S5<S6<S7) in accordance with the distance from the ink discharge port 127 as shown in the plan view of FIG. 8. Alternatively, the pitch P1–P6 between adjacent ones of the communication holes 133 may be set to decrease (that is, P1>P2>P3>P4>P5>P6) in accordance with the distance from the suction port as shown in the plan view of FIG. 9. Thus, the suction power becomes substantially uniform in the length direction of the suction channel 134 so that the idle suction of ink can be performed more surely and efficiently.

Figure 10:
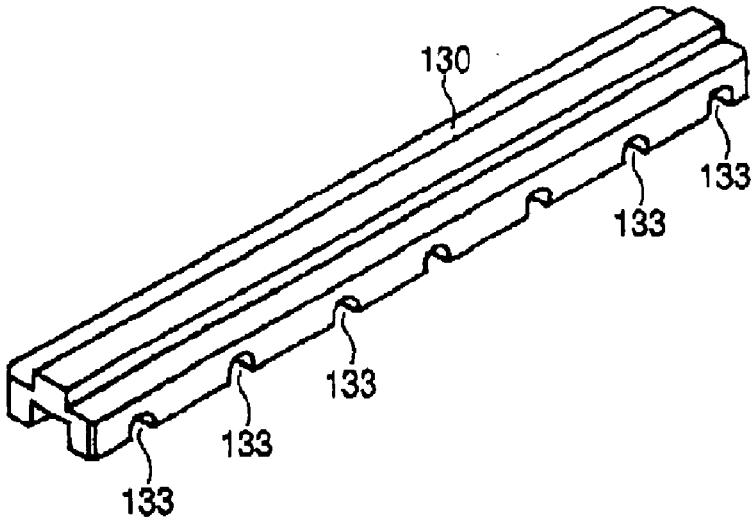
FIG. 10 is a perspective view showing another embodiment of an ink guide member according to the invention.

Further, the communication holes 133 may be formed at any position of the ink guide member 130 if they allow the suction channel 134 to communicate with the atmosphere. For example, as shown in the perspective view of FIG. 10, a plurality of communication holes 133 may be formed along the lower edges of the left and right side walls of the ink guide member 130, and the number of the communication holes 133 may be set arbitrary.

As is apparent from the above description, according to a first aspect of this embodiment, a suction channel 134 is defined between the ink guide member 130 and the suction cap 107*a,* 107*b.* In idle suction of ink after purge suction, ink can be sucked and discharged forcibly from the ink discharge port 127 open to the suction channel 134. Thus, the idle suction of ink can be performed efficiently without inclining the bottom surface in the suction cap 107*a,* 107*b.* As a result, the height of the suction cap 107*a,* 107*b* can be kept to a minimum. Thus, there can be obtained an advantage that the purge unit and hence the inkjet recording apparatus as a whole can be made thinner.

According to a second aspect of this embodiment, the suction channel 134 communicates with the atmosphere through the at least one communication hole 133. Thus, the ink remaining in the suction cap 107*a,* 107*b* is sucked and discharged through the ink discharge port 127 together with the air flowing into the suction channel 134 through the at least one communication hole 133.

According to a third aspect of this embodiment, the sectional area of each communication hole 133 is set to increase in accordance with the distance from the ink discharge port 127 of the suction cap. On the other hand, according to a fourth aspect of this embodiment, the pitch between adjacent ones of the communication holes 133 is set to decrease in accordance with the distance from the ink discharge port of the suction cap. Thus, the suction power becomes substantially uniform in the length direction of the suction channel 134 so that the idle suction of ink can be performed surely and efficiently.

According to a fifth aspect of this embodiment, the strength and rigidity of the ink guide member 130 are enhanced by the reinforcing rib 132 provided to rise in the width-direction central portion of the top surface of the ink guide member 130. Thus, failure such as damage of the ink guide member 130 does not occur in spite of a plurality of communication holes 133 formed on the opposite sides of the reinforcing rib 132.

According to a sixth aspect of this embodiment, the bottom surface in the suction cap 107*a,* 107*b* does not have to be inclined because the ink guide member 130 is used. Thus, the height of the suction cap 107*a,* 107*b* can be minimized.

According to a seventh aspect of this embodiment, the purge unit 104 includes the suction cap 107*a,* 107*b* whose height has been minimized. Thus, the height of the purge unit 104 can be also minimized.

Second Embodiment

Now, a second embodiment of the invention will be described below.

First, a main portion (recording engine E) of an inkjet recording apparatus for jetting ink onto paper to thereby form an image will be described with reference to FIG. 12. The inkjet recording apparatus is provided with a flat platen 202, a carriage guide shaft 204, a carriage 206, a carriage moving mechanism, a paper moving mechanism (not shown) and an inkjet head 210. The flat platen 202 supports paper 200 (see FIG. 13). The carriage guide shaft 204 extends above the platen 202 and in a direction perpendicular to a transporting direction F of the paper 200. The carriage 206 can slide on the carriage guide shaft 204 relatively thereto. The carriage moving mechanism includes a CR motor 208 and so on for moving the carriage 206 along the carriage guide shaft 204. The paper moving mechanism moves the paper 200 in the transporting direction F in accordance with necessity. The inkjet head 210 is fixed to the carriage 206.

A flat nozzle plate 212 is disposed under the inkjet head 210. A plurality of ink nozzles for jetting ink downward are formed in the nozzle plate 212 correspondingly to four colors of Y (yellow), M (magenta), C (cyan) and K (black) as shown in FIG. 34. The ink nozzles are formed in four arrays 213 parallel to the transporting direction F of the paper 200.

Figure 13:
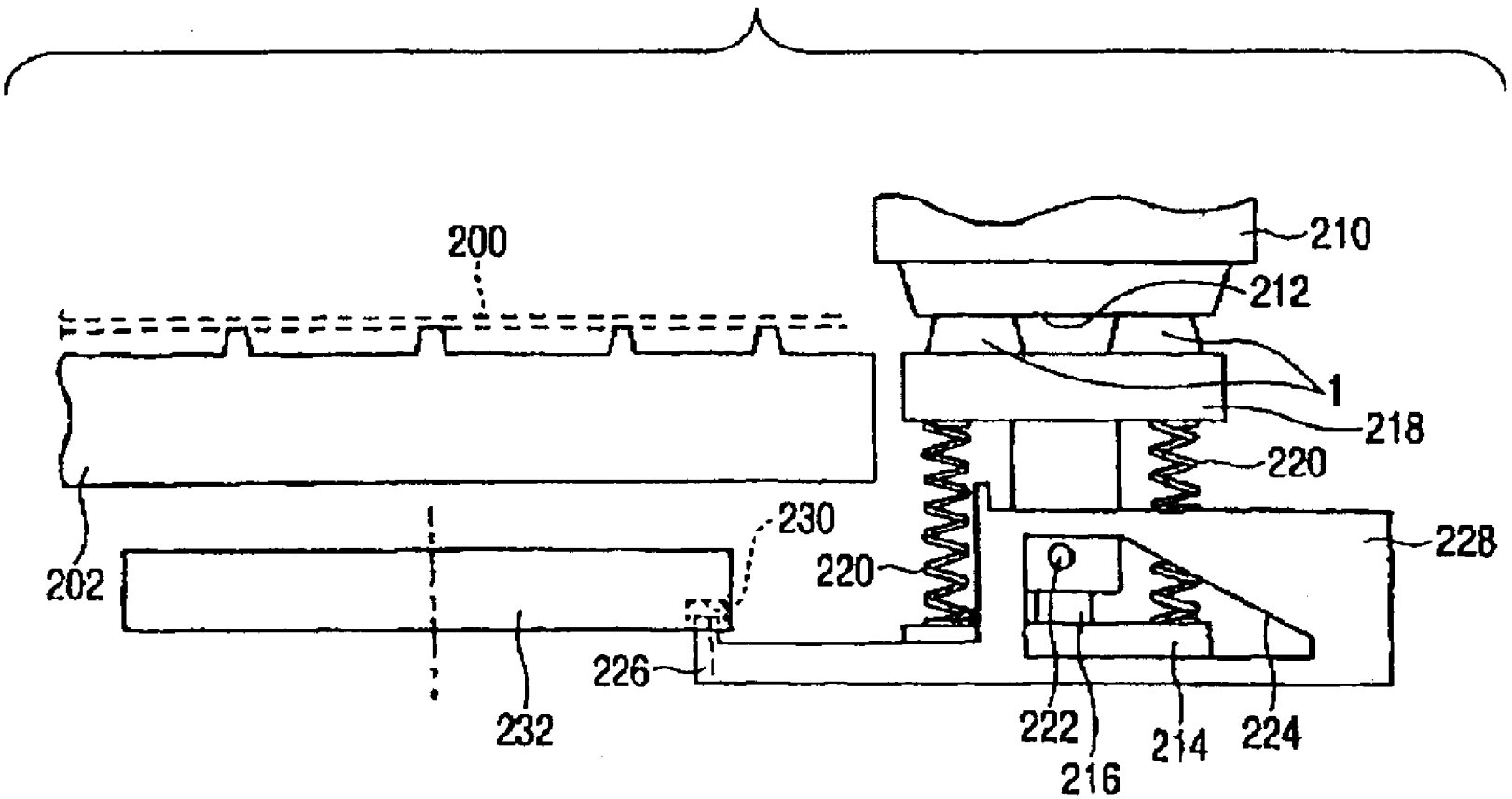
FIG. 13 is a view showing the vicinities of a suction cap.

As shown in FIG. 13, the inkjet recording apparatus has a cap holder base 214, a guide shaft 216, a cap holder 216, two suction caps 1, two push springs 220, a cam shaft 222, a slider 228, a groove cam 230 and a disc 232. The cap holder base 214 is disposed immovably under an end portion of the inkjet head 210 in the reciprocating range of the inkjet head 210. The guide shaft 216 extends upward from the cap holder base 214. The cap holder 218 is movable vertically along the guide shaft 216. The suction caps 1 are provided at the upper end of the cap holder 218 so that the suction caps 1 can engage with the nozzle plate 212 under the inkjet head 210. The suction caps 1 receive ink jetted from the ink nozzles of the nozzle plate 212. The push springs 220 urge the cap holder 218 upward along the guide shaft 216. The cam shaft 222 extends horizontally from below the cap holder 218. The slider 228 can move in the left/right direction in FIG. 13. In the slider 228, a cam surface 224 and a cam arm 226 are formed. The cam surface 224 can be separated from and engaged with the cam shaft 222, so as to send the cap holder 218 down relatively to the guide shaft 216. The cam arm 226 protrudes upward. The groove cam 230 can engage with the cam arm 226. The disc 232 can rotate around a central axis shown by the chain line.

When the disc 232 is rotated by a motor (not shown) or the like so that the distance between the central axis and the groove cam 230 is secured as shown in FIG. 13, the cam shaft 222 is separated from the cam surface 224, and the cap holder 218 is moved up by the push springs 220. The cam arm 226 is located as shown in FIG. 13, and the nozzle plate 212 engages with the suction caps 1 so that the suction caps 1 can receive ink from the nozzle plate 212. On the other hand, when the disc 232 is rotated by the motor so that the distance between the central axis and the cam groove 228 becomes shorter than that shown in FIG. 13, the cam arm 226 moves to the left in FIG. 13 and the cam surface 224 also moves to the left so as to push the cam shaft 222 down against the elastic force of the push springs 220. Thus, the suction caps 1 are separated from the inkjet head 210 so that the carriage 206 can move in a direction perpendicular to the transporting direction F.

Figure 12:
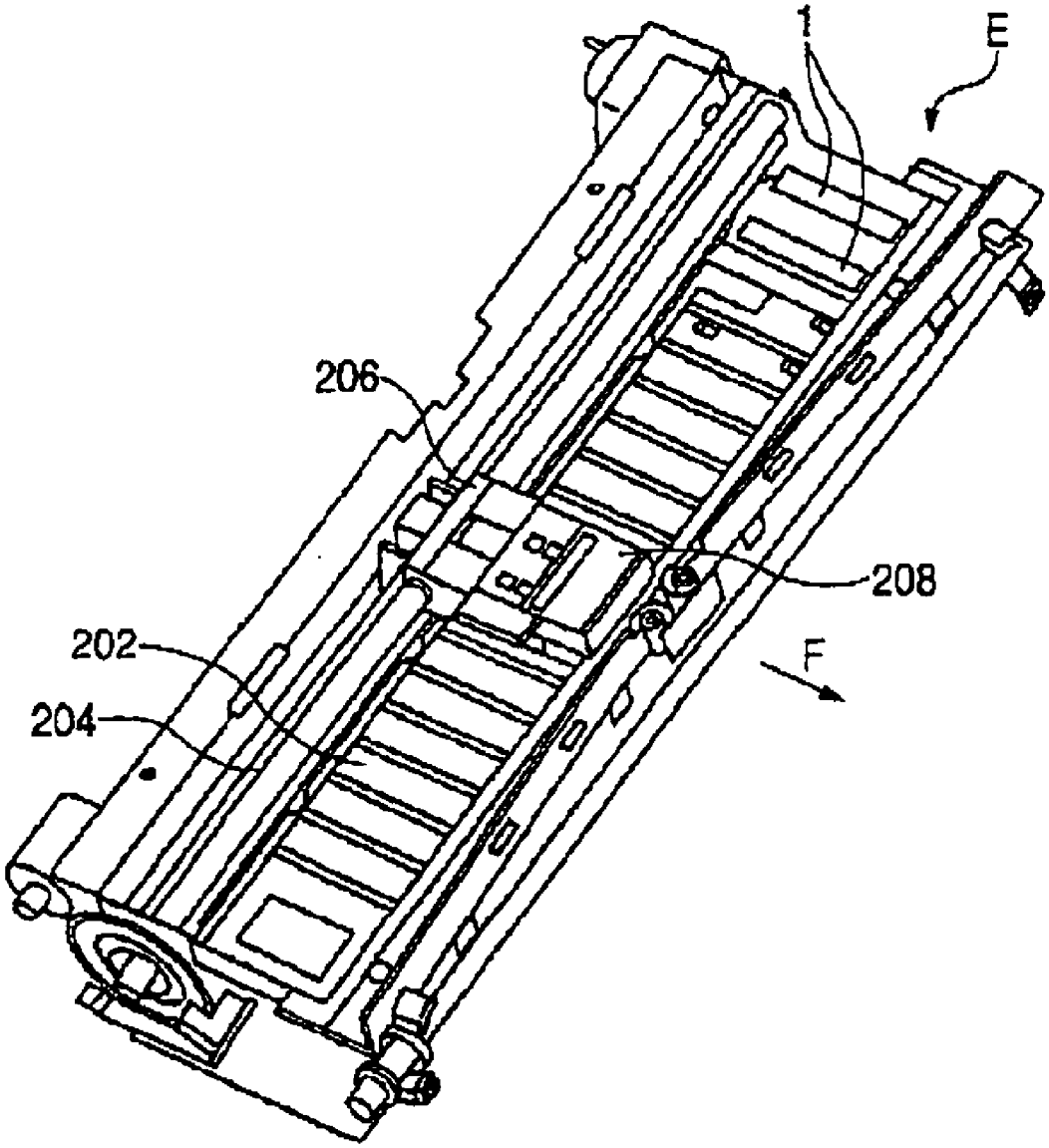
FIG. 12 is a perspective view showing a main portion (recording engine) for forming an image.

The inkjet recording apparatus shown in FIGS. 12 and 13 has the same configuration with that of the multifunctional apparatus 91 shown in FIG. 11.

Figure 14:
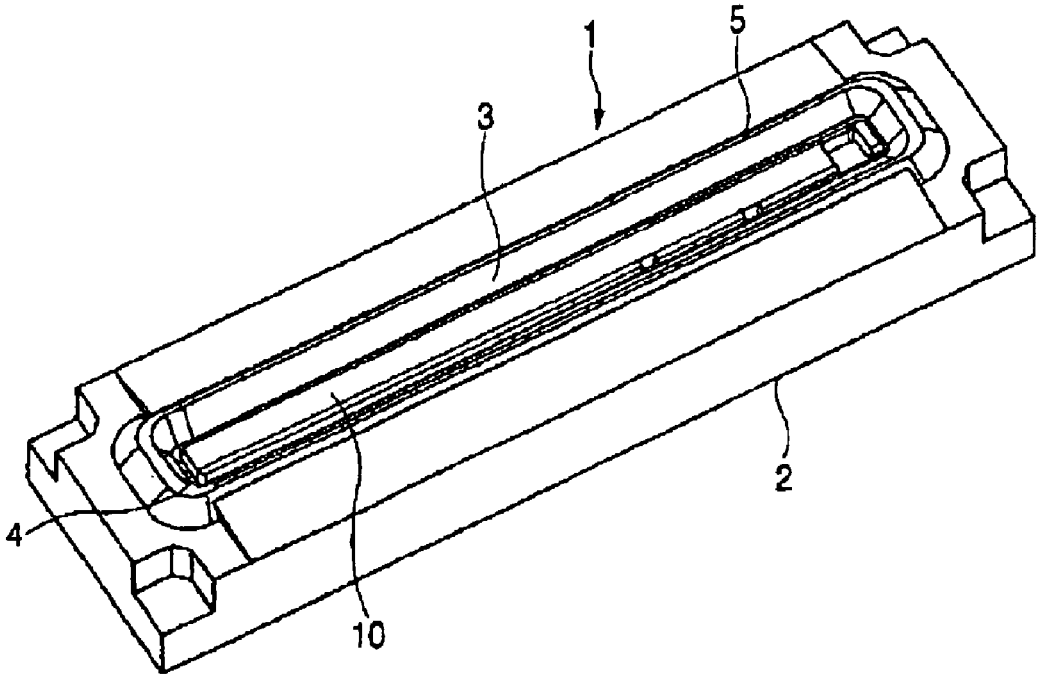
FIG. 14 is a perspective view showing the suction cap according to another embodiment of the invention.
Figure 15:
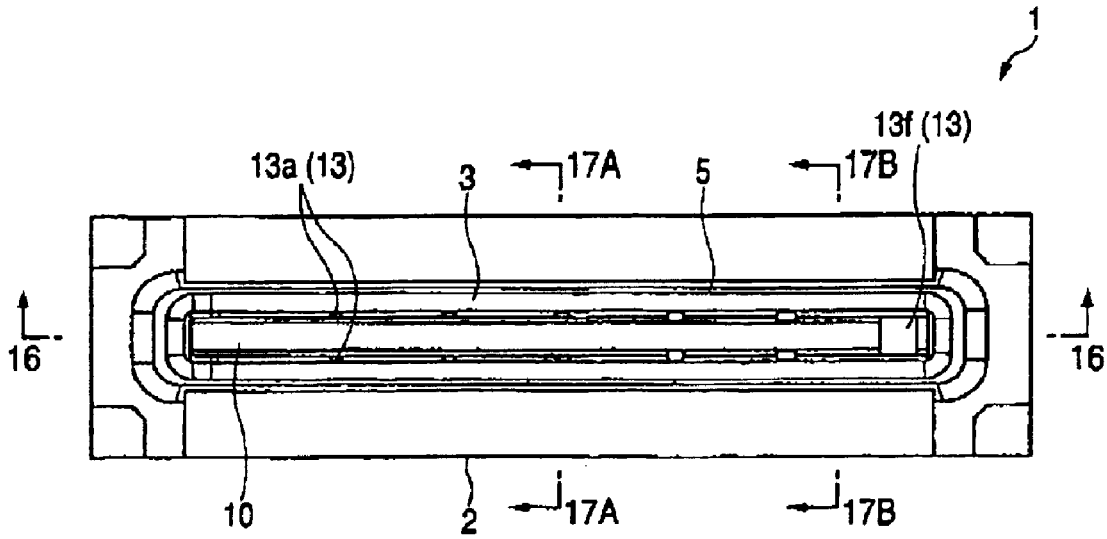
FIG. 15 is a plan view showing the suction cap.

Subsequently, description will be given of the configuration of the suction cap in the second embodiment of the inkjet recording apparatus according to the invention. Chiefly as shown in FIGS. 14 and 15, the suction cap 1 includes a cap member 2 and an ink guide member 10. The cap member 2 forms a concave portion 3 for defining a space with the nozzle plate 212 when the suction cap 1 is brought into contact with the nozzle plate 212 under the inkjet head 210. The ink guide member 10 is disposed in the concave portion 3. The cap member is formed by molding out of a rubber material such as butyl rubber. A contact portion 5 for contacting with the nozzle plate 212 is formed in the circumferential edge portion of the concave portion 3.

Figure 16:
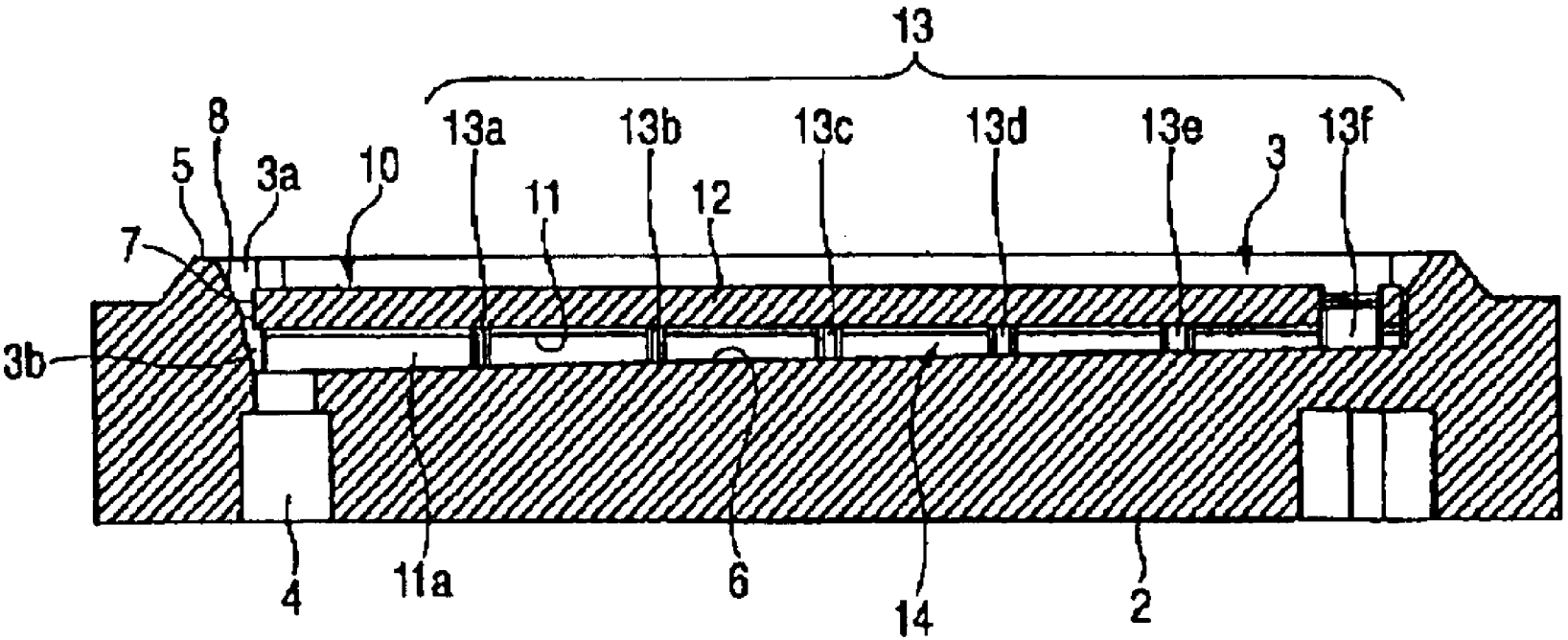
FIG. 16 is a sectional view taken along line 16—16 in FIG. 15.
Figure 17A:
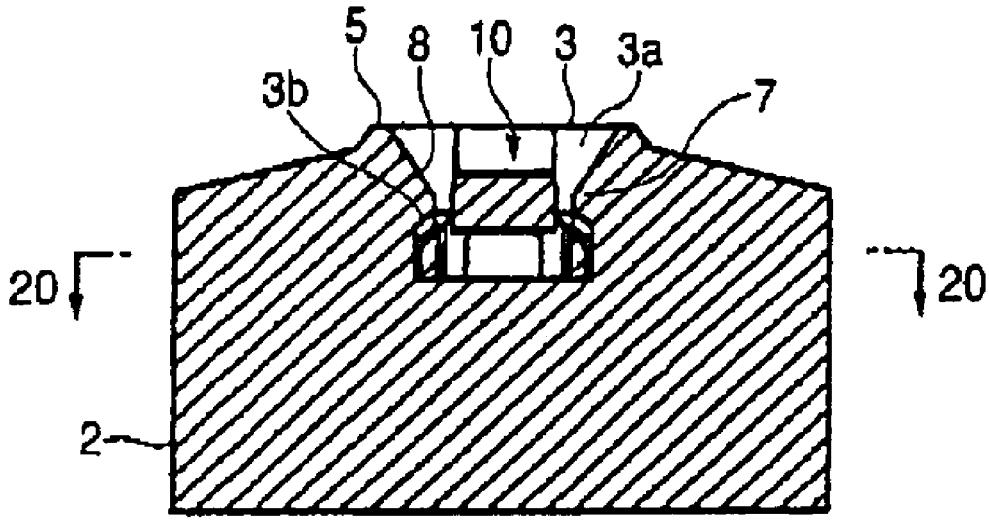
FIG. 17A is a sectional view taken along line 17A—17A in FIG. 15.
Figure 17B:
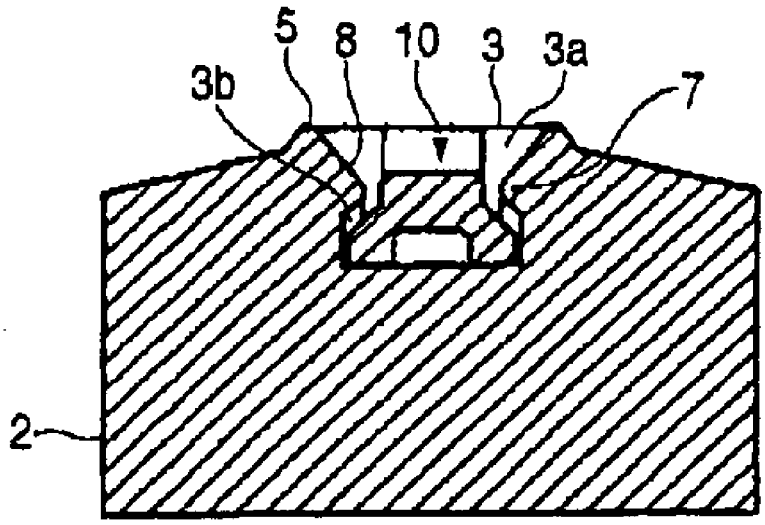
FIG. 17B is a sectional view taken along line 17B—17B in FIG. 15.
Figure 18A:
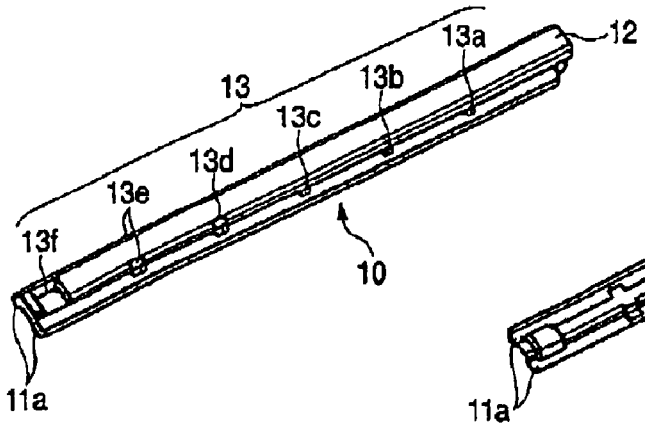
FIG. 18A is a perspective view showing an ink guide member from the top surface side.
Figure 18B:
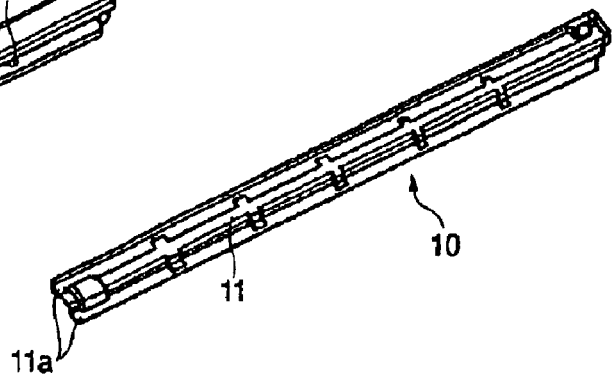
FIG. 18B is a perspective view showing the ink guide member from the bottom surface side.

The concave portion 3 of the cap member 2 is formed to be long in the same direction as the arrays of a plurality of nozzles in the inkjet head 210. As shown in FIG. 16 and FIGS. 17A and 17B, the concave portion 3 has a first concave portion 3*a* located on the nozzle plate 212 side in the concave portion 3, a second concave portion 3*b* sinking from the bottom surface of the first concave portion 3*a* to the opposite side to the nozzle plate 212, and an ink discharge port 4 formed in a bottom surface 6 of the second concave portion 3*b*.

The first concave portion 3*a* is formed to have a wall surface (slope 8) inclined and tapered, so as to sink down continuously from the contact portion 5 and make its sectional area narrower gradually as the location goes closer to the second concave portion 3*b*. The second concave portion 3*b* is formed to extend like a groove in the same direction as the nozzle arrays of the inkjet head 210, and to be inclined so that one longitudinal end of the second concave portion 3*b* becomes lower than the other end of the second concave portion 3*b*. The ink discharge port 4 is formed in one longitudinal end of the bottom surface 6 of the second concave portion 3*b* which end is the lowest with respect to the vertical direction.

The lower end of the wall surface (slope 8) of the first concave portion 3*a* is formed as a protrusion portion 7 protruding to narrow the open surface of the second concave portion 3*b*. The protrusion portion 7 can be deformed due to the elasticity of rubber. Though not shown, a suction pump communicates with the ink discharge port 4 through a tube while the suction pump communicates with a waste ink reservoir portion through another tube.

The ink guide member 10 is fitted into the cap member 2 so as to cover the concave portion 3 of the cap member 2 from above. The left and right ends of the top surface of the ink guide member 10 are locked in the left and right parts of the protrusion portion 7 of the cap member 2. Thus, the ink guide member 10 is incorporated in the cap member 2. That is, the ink guide member 10 is prevented from being detached from the cap member 2 unexpectedly.

The ink guide member 10 is molded into a substantially rectangular column-like shape out of resin hard to suffer erosion due to ink, such as polyacetal (POM) resin. As shown in FIGS. 18A to 18E and FIGS. 19A to 19F, a concave groove-like channel 11 having a rectangular shape in section and having a predetermined length is provided at the width-direction center of the bottom surface of the ink guide member 10 so as to penetrate the bottom surface lengthwise. Foot portions 11*a* extending downward are formed on the opposite sides of the bottom surface integrally therewith. In addition, a rectangular column-like rib 12 is provided at the width direction center of the top surface of the ink guide member 10 integrally therewith so as to rise and extend lengthwise.

Figure 19A:
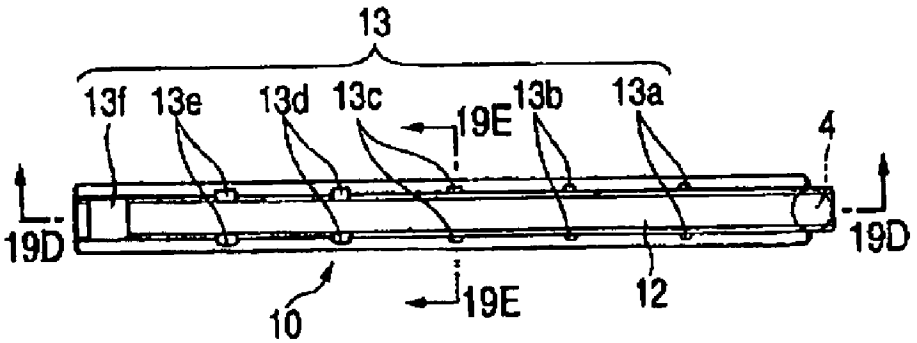
FIG. 19A is a plan view showing the ink guide member.
Figure 19B:
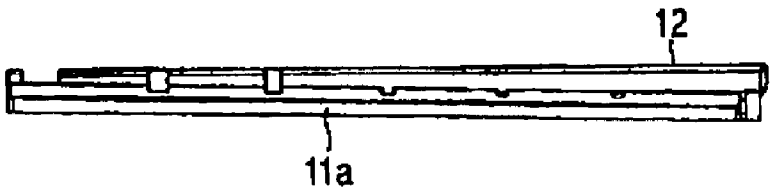
FIG. 19B is a front view thereof.
Figure 19C:
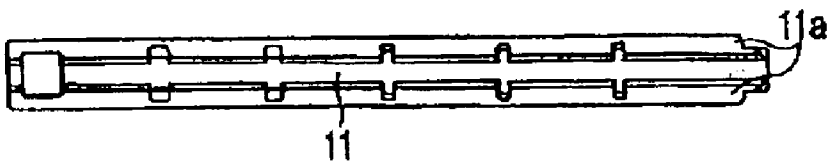
FIG. 19C is a bottom view thereof.
Figure 19D:
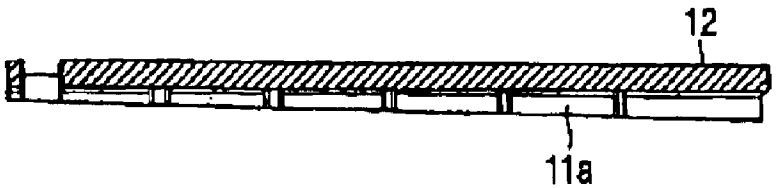
FIG. 19D is a sectional view taken along line 19D—19D in FIG. 19A.
Figure 19E:
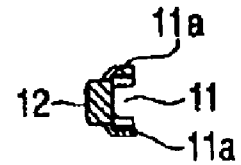
FIG. 19E is a sectional view taken along line: 19E—19E in FIG. 19A.
Figure 19F:
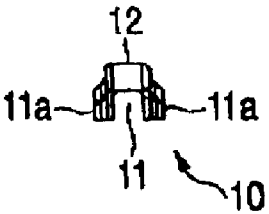
FIG. 19F is a right side view thereof.

In the areas where the top surfaces of the foot portions 11*a* on the opposite sides of the rib 12 of the ink guide member 10 intersect the rib 12, a plurality of communication holes 13 are provided lengthwise at intervals of a regular pitch so as to penetrate the areas vertically. In addition, as shown in FIG. 19A, pairs of holes 13*a* to 13*e* are arranged in the order of increasing size, so that a hole farther from the ink discharge port 4 has a larger size, that is, a larger horizontal sectional area. Further, one hole 13*f* having the largest sectional area is formed in the position farthest from the ink discharge port 4, so as to penetrate the rib 12. As described previously, in a communication hole 13 farther from the ink discharge port 4, the sectional area of the communication hole 13 becomes larger, and the channel in the communication hole 13 also becomes larger.

As described previously, in the state where the ink guide member 10 has been fitted into the cap member 2 and locked therein, the suction channel 14 is defined between the concave groove-like channel 11 of the ink guide member 10 and the cap member 2 as shown in FIG. 16 and FIGS. 17A and 17B. The ink discharge port 4 communicates with the suction channel 14 while the suction channel 14 communicates with the atmosphere through the plurality of communication holes 13.

In this case, the foot portions 11*a* of the ink guide member 10 become shorter as the distance from the ink discharge port 4 increases. Then, the lower ends of the foot portions 11*a* abut against the bottom surface 6 inclined to the ink discharge port 4 so as to be lower in vertical direction toward the ink discharge port 4. Accordingly, the distance between the bottom surface 6 and the ceiling surface of the concave groove-like channel 11 opposed to the bottom surface 6 also becomes smaller as the distance from the ink discharge port 4 increases. The rib 12 of the ink guide member 10 is disposed horizontally. Incidentally, the distance is set to be larger in an area near the ink discharge port 4 than in an area distant from the ink discharge port 4. That is, the channel expands vertically near the ink discharge port 4.

Further, the opening of the ink discharge port 4 on the second concave portion 3*b* side is covered with one longitudinal end portion of the ink guide member 10. In other words, the ceiling surface of the concave groove-like channel 11 faces substantially all the area of the ink discharge port 4. In addition, of the communication holes 13, the hole 13*a* the closest to the ink discharge port 4 is formed in a position at a predetermined distance from the ceiling portion of the concave groove-like channel 11 facing substantially all the area of the ink discharge port 4.

Figure 20:
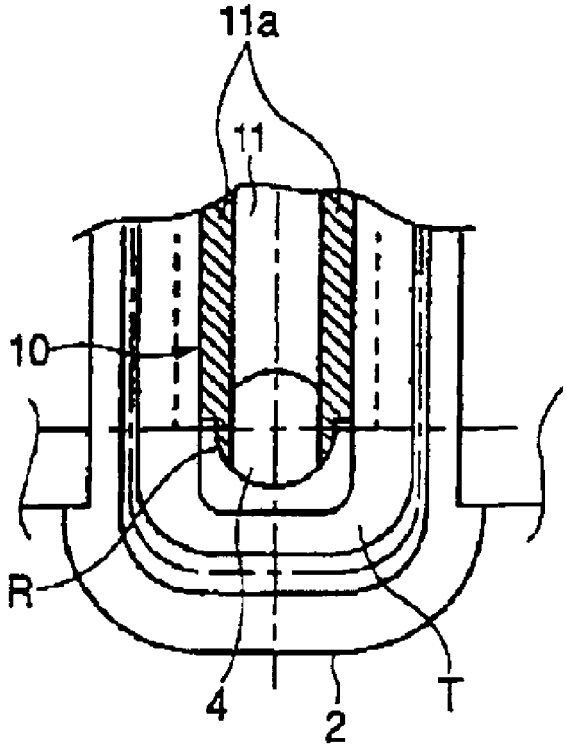
FIG. 20 is a sectional view taken along line 20—20 in FIG. 17A.

FIG. 20 is a sectional view taken along line 20—20 in FIG. 17A, showing the state of the ink discharge port 4 and its vicinities. As shown in FIG. 20, in the ink guide member 10, an end portion near the ink discharge port 4, specifically, an end portion of the foot portion 11*a* is formed into a round-off surface shape following the circumferential edge portion of the ink discharge port 4. Thus, the flow of ink around the ink discharge port 4 is made smooth. That is, since the ink guide member 10 is arranged to face substantially all the area of the ink discharge port 4 from right above, excessive negative pressure may be generated near the ink discharge port 4 so as to increase the residual quantity of ink. Thus, in order to prevent the residual quantity of ink from increasing in such a manner, a short channel T (see FIG. 20) is formed, along the end portions of the foot portions 11*a* so that the ink or the atmosphere reaches the ink discharge port 4 from above and along the end portions of the foot portions 11*a*.

Incidentally, for example, the material of the cap member 2 is butyl rubber, and the material of the ink guide member 10 is polyacetal (POM) resin, as described previously. That is, the ink guide member 10 is formed out of a material whose wettability is higher than that of the cap member 2. As a result, it becomes easy to generate a capillary effect on ink so that it is possible to prompt the ink to flow smoothly.

Wettability cannot be defined as a physical property value. However, the diameter of a drop of water spread on the surface of a material after the drop of water is dropped with a syringe is defined as a measure of wettability of the material. In this case, the wettability of butyl rubber is about 3 mm, and that of POM is about 4 mm. The spreading of water on POM is larger and POM is more familiar to water. It is therefore understood that the wettability of POM is higher. That is, due to the difference in wettability between the cap member 2 and the ink guide member 10, ink is not allowed to stay on the cap member 2, and the ink can be collected on the ink guide member 10 side. In addition, the communication holes 13 are disposed in the area where the rib 12 intersects the foot portion 11*a* so that the ink can be sucked more efficiently. This is because the ink is collected, by its own surface tension, in a corner portion formed out of the two surfaces of the foot portion 11*a* and the rib 12.

Now, description will be given of an ink jet recovering process using the suction cap 1 configured thus. When the carriage 206 is present in a reset position (which is a position opposite to the suction cap 1 as shown in FIG. 12), the suction cap 1 is moved up so that the contact portion 5 thereof is brought into contact with the nozzle plate 212. Thus, the surroundings of the ink nozzles of the nozzle plate 212 are covered with the suction cap 1 so that an enclosed space is defined by the nozzle plate 212 and the concave portion 3. Next, negative pressure is generated suddenly in the enclosed space by the suction pump (not shown) so as to suck ink from the inside of the inkjet head 210 through the nozzle plate 212. The sucked ink is discharged to the waste ink reservoir portion through the ink discharge port 4. This suction pump generates the negative pressure instantaneously and temporarily with a piston or the like.

Then, the suction cap 1 is moved down so that the contact portion 5 is separated from the nozzle plate 212. The suction pump is driven in this state where the suction cap 1 has been separated (that is, released from sealing), so that the ink in the concave portion 3 of the suction cap 1 is discharged to the waste ink reservoir portion through the ink discharge port 4. In this situation, due to the suction channel 14 defined between the ink guide member 10 and the cap member 2 by the ink guide member 10 incorporated in the cap member 2, the ink can be sucked and discharged forcibly from the ink discharge port 4 open to the suction channel 14.

In addition, the suction channel 14 defined in the suction cap 1 communicates with the atmosphere through a plurality of communication holes 13. Thus, the ink remaining in the suction cap 1 is sucked into the ink discharge port 4 and discharged therefrom efficiently together with the air flowing into the suction channel 14 through the communication holes 13.

Figure 21:
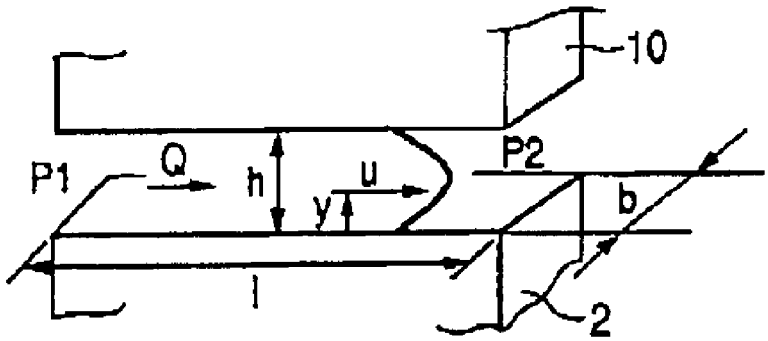
FIG. 21 is a schematic view for explaining basic equations of a flow through a microgap.

Subsequently, the principle on which the ink remaining in the suction cap 1 is removed will be reviewed. FIG. 21 is a schematic view for explaining basic equations for a flow through a microgap. Here, the inside of the cap member 2 with the ink guide member 10 incorporated therein is regarded as a channel formed out of a microgap. In FIG. 21, the following basic equations are established.

$$u=\Delta p(h-y)y/2\ \mu l$$

$$Q=bh3\Delta p/12\ \mu l$$

Provided:

u: flow velocity

Q: flow rate

Δp: pressure loss (P1−P2)

h: gap height b: channel width l: channel length $\mu$; viscosity coefficient

It is understood from the basic equations that the flow rate Q is proportional to the width b, proportional to the cube of the height h, and inversely proportional to the length l. That is, the value of the height exerts a greater influence on the flow rate than the value of the width.

Figure 22A:
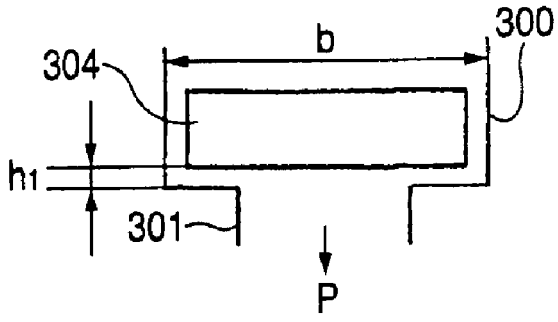
FIGS. 22A and 22B are diagrams each schematically showing the section of a channel in a suction cap.
Figure 22B:
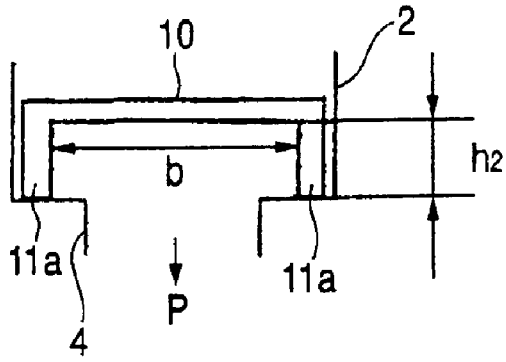
Figure 24A:
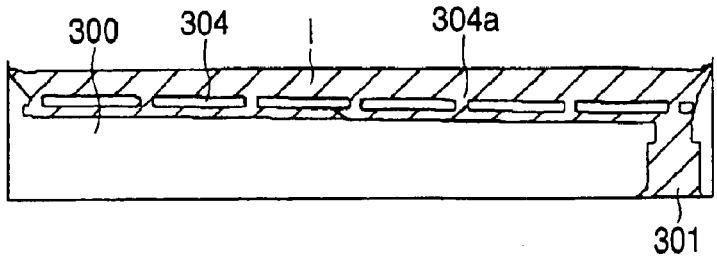
FIG. 24A [Related Art]
Figure 24B:
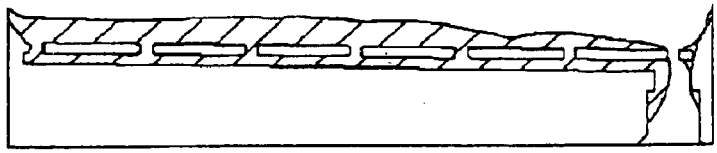
FIG. 24B [Related Art]
Figure 24C:
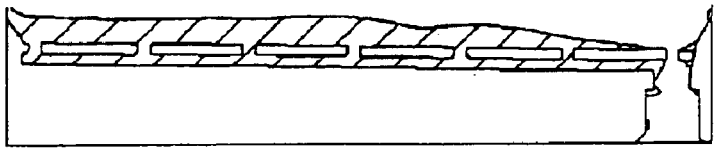
FIG. 24C [Related Art]
Figure 24D:
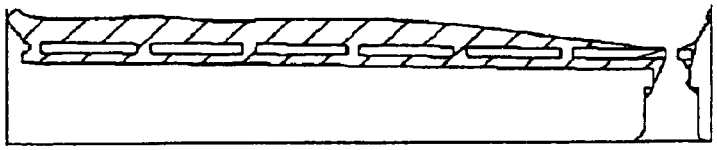
FIG. 24D [Related Art]
Figure 26:
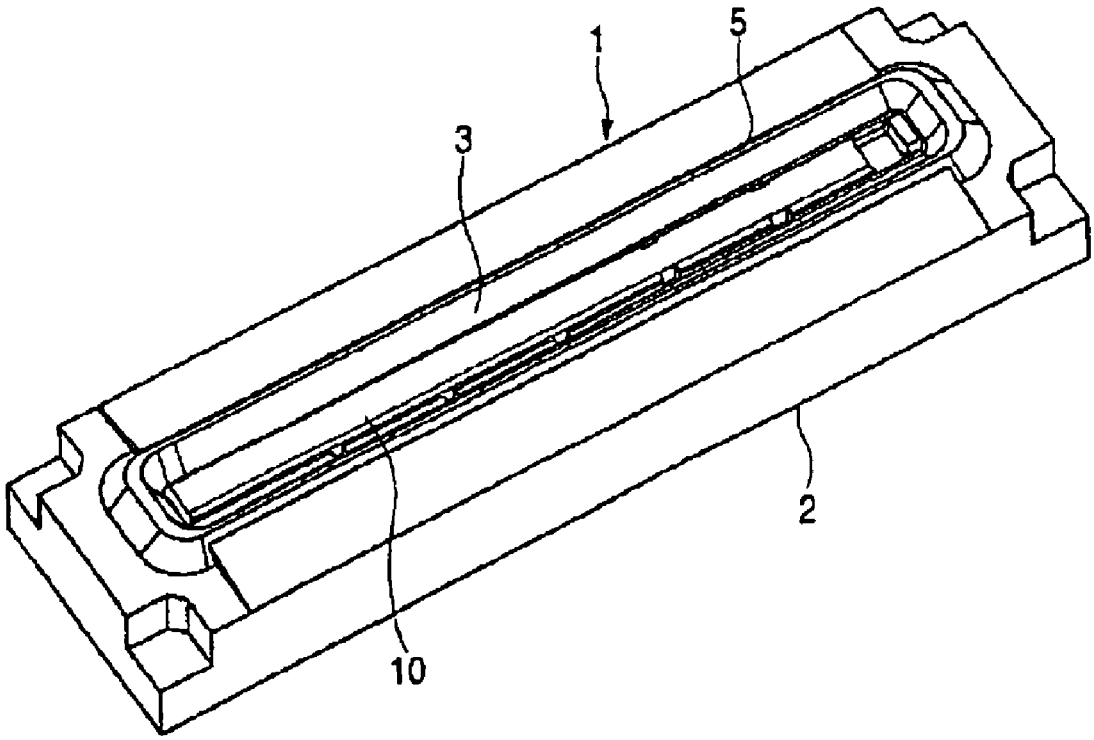
FIG. 26 is a perspective view showing a suction cap according to another embodiment of the invention.
Figure 27:
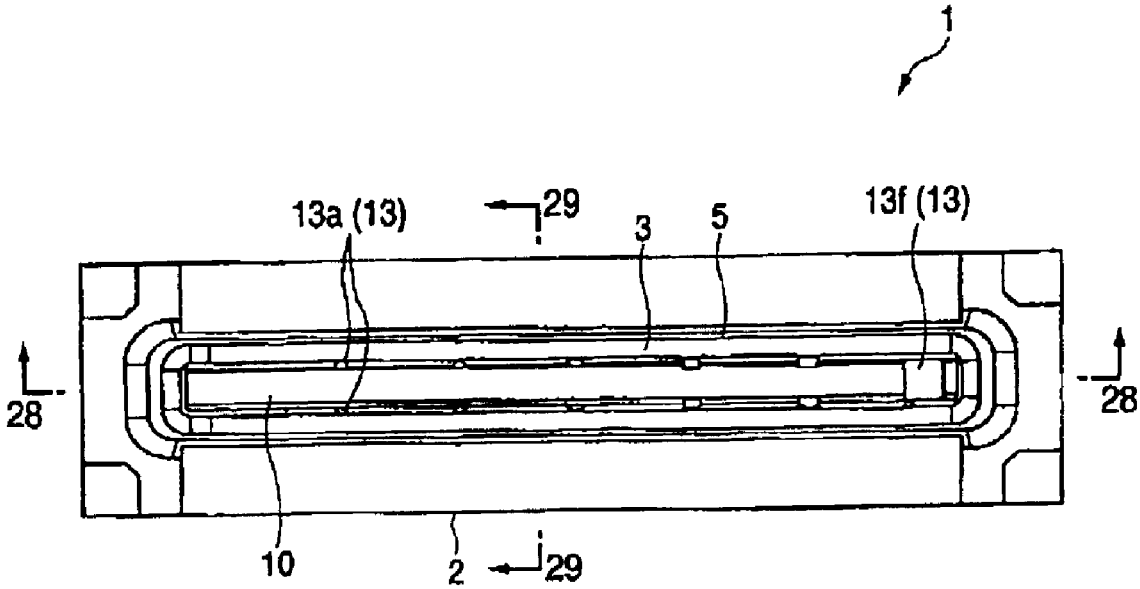
FIG. 27 is a plan view showing the suction cap.

FIGS. 22A and 22B are diagrams schematically showing sections of channels in the suction caps 1 and 300 respectively. FIG. 22A shows the configuration in which an ink guide member in the related art has been incorporated. FIG. 22B shows the configuration in which the ink guide member 10 according to the invention has been incorporated. As shown in FIG. 22A, according to the related art, a capillary effect generating member 304 which is a ink guide member shaped like a substantially flat plate (having a rectangular shape in section) has been incorporated in the cap 300. Thus, the width b is indeed secured, but the gap height h is limited to a low value.

On the other hand, according to the invention, as shown in FIG. 22B, the width b is indeed limited by the foot portions 11*a* extending downward from the left and right sides of the ink guide member 10, but the gap height h having a cubic effect is secured (see h1<h2 in FIGS. 22A and 22B). As a result, as is understood from the equations, a very far larger flow rate Q can be obtained according to the invention than according to the related art when suction is carried out from the ink discharge ports 101 and 4 with the same suction pressure P.

FIGS. 23A to 23D, FIGS. 24A to 24D and FIGS. 25A to 25D are sectional views each showing a simulation of an ink flow in a suction cap. FIGS. 23A–23D show the case where a related art ink guide member (capillary effect generating member 304) having a substantially flat-plate-like shape and having no communication hole has been incorporated in a cap member (cap 300). The ink guide member is put on the bottom surface of the cap member so that an ink discharge port 301 is partially covered with an end portion of the ink guide member.

FIGS. 24A to 24D show the case where a related-art ink guide member (capillary effect generating member 304) having communication holes 304*a* of a uniform size has been incorporated in a cap member (cap 300). The ink guide member is provided to keep a predetermined distance from the bottom surface of the cap member. A communication hole is opened also just above an ink discharge port 301.

FIGS. 25A to 25D show the case where the ink guide member 10 according to the invention has been incorporated in the cap member 2. The ink guide member 10 has holes the size of which increases in accordance with the distance from the discharge port. The ink guide member 10 is provided so that the distance between the ink guide member 10 and the bottom surface 6 of the cap member 2 is reduced in accordance with the distance from the ink discharge port 4. The ink guide member 10 has a face portion facing all the area of the ink discharge port 4.

FIGS. 23A to 23D, FIGS. 24A to 24D and FIGS. 25A to 25D show the conditions of ink at 0 sec, 0.03 sec, 0.05 sec and 0.1 sec after the start of suction, respectively. FIGS. 23E, 24E and 25E are tables showing the analysis conditions. Incidentally, in each table, "chip" designates an ink guide member (capillary effect generating member in the related art), "cap" designates a cap member, and "hole" designates a communication hole.

Ink in each cap member has the following ink volume (fluid volume).

| | initial ($cm^3$) | 0.1 sec later ($cm^3$) | residual rate |
|---|---|---|---|
| FIG. 12 | 0.058 | 0.043 | 0.742 |
| FIG. 13 | 0.077 | 0.053 | 0.690 |
| FIG. 14 | 0.078 | 0.025 | 0.314 |

As is understood from FIGS. 23A to 23D, FIGS. 24A to 24D and FIGS. 25A to 25D, according to the related-art configuration shown in FIGS. 23A to 23D or 24A to 24D, ink I near the ink discharge port 301 is sucked in an early stage, and the ink discharge port 301 communicates with the atmosphere quickly. Thus, there appears a flow chiefly allowing the air to enter the ink discharge port 301. As a result, essential negative pressure on the ink I is lost so that the suction efficiency of the ink I decreases dramatically.

On the other hand, according to the configuration of the invention shown in FIGS. 25A to 25D, even if the ink I near the ink discharge port 4 is sucked, the ink discharge port 4 does not communicate with the atmosphere quickly. Thus, the ink I is discharged efficiently through each communication hole 13. As a result, according to the invention, the survival rate of the ink I is reduced to half or less in comparison with that in the related art, and an evident effect can obtained.

Third Embodiment

Now, description will be given of the configuration of a suction cap of an inkjet recording apparatus according to a third embodiment of the invention. In FIGS. 26–30 and 31A–31C, members and portions having the same functions as those in the second embodiment are denoted by the same reference numbers correspondingly, and description thereof will be omitted accordingly. In this embodiment, the foot portions 11*a* of the ink guide member 10 are omitted. Alternatively, as shown in FIG. 29, a support portion 9 for supporting the ink guide member 10 is integrally provided under the protrusion portion 7 of the cap member 2 by molding. The distance between the ink guide member 10 and the bottom surface 6 of the cap member 2 is defined by the support portion 9. In this embodiment, the support portion 9 is provided substantially in parallel with the contact portion 5 of the cap member 2 so that the distance from the bottom surface 6 increases as the distance from the ink discharge port 4 decreases.

Figure 31A:
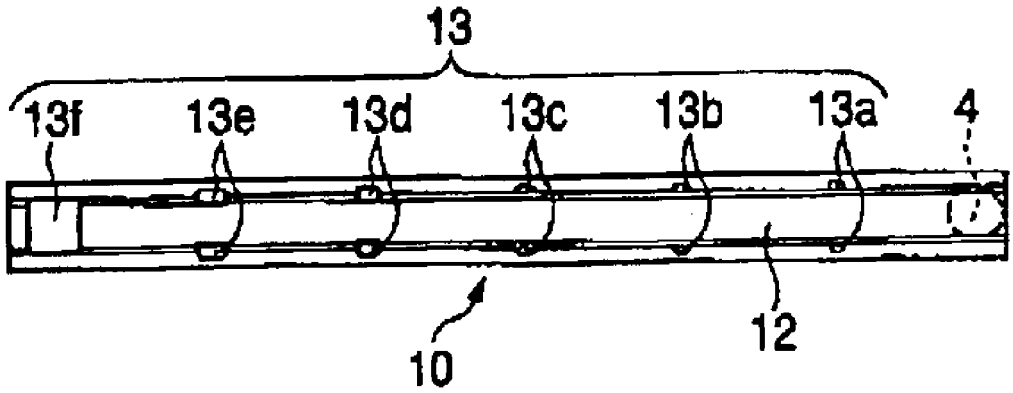
FIG. 31A is a plan view showing the ink guide member.
Figure 31B:
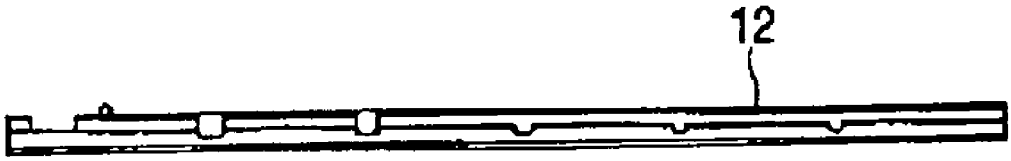
FIG. 31B is a front view thereof.
Figure 31C:
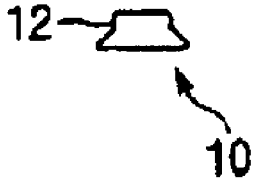
FIG. 31C is a right side view thereof.

On the opposite sides of the rib 12 of the ink guide member 10, a plurality of communication holes 13 are provided lengthwise at intervals of a regular pitch so as to penetrate the ink guide member 10 vertically in the area where the top surface of the ink guide member 10 intersects the rib 12. In addition, as shown in FIG. 31A, the hole sizes, that is, the horizontal sectional areas of the holes 13*a* to 13*e* increase in that order such that a hole farther from the ink discharge port 4 has a larger hole size. In addition, a hole 13*f* having the largest hole size is provided in the farthest position from the ink discharge port 4 so as to penetrate the rib 12.

Figure 28:
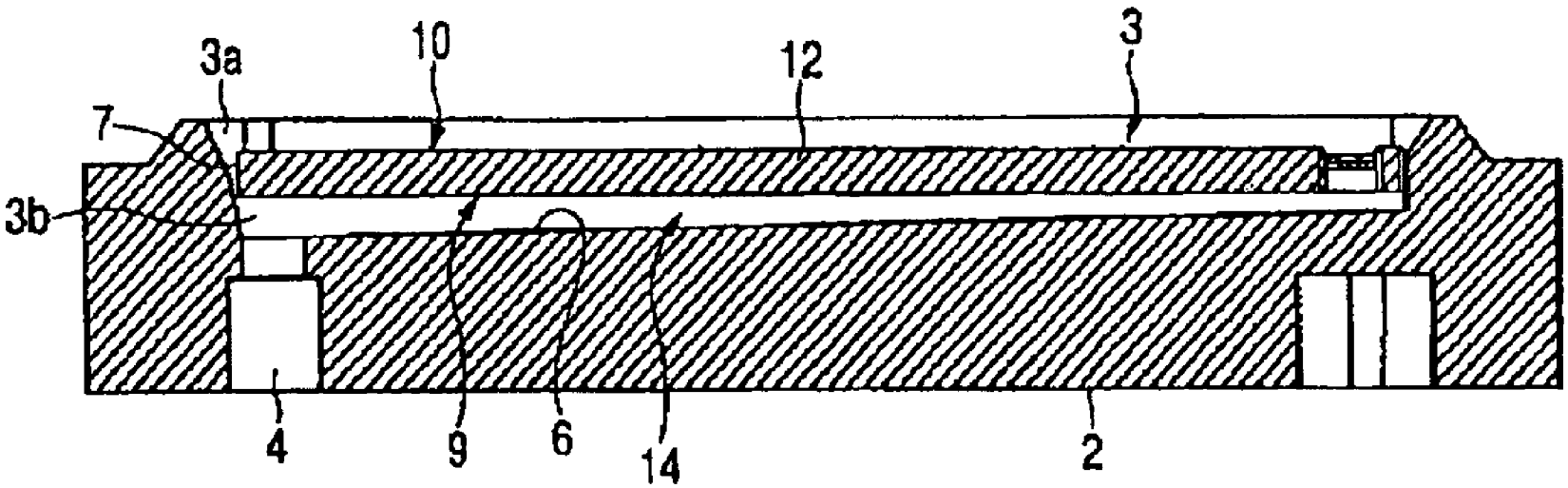
FIG. 28 is a sectional view taken along line 28—28 in FIG. 27.
Figure 29:
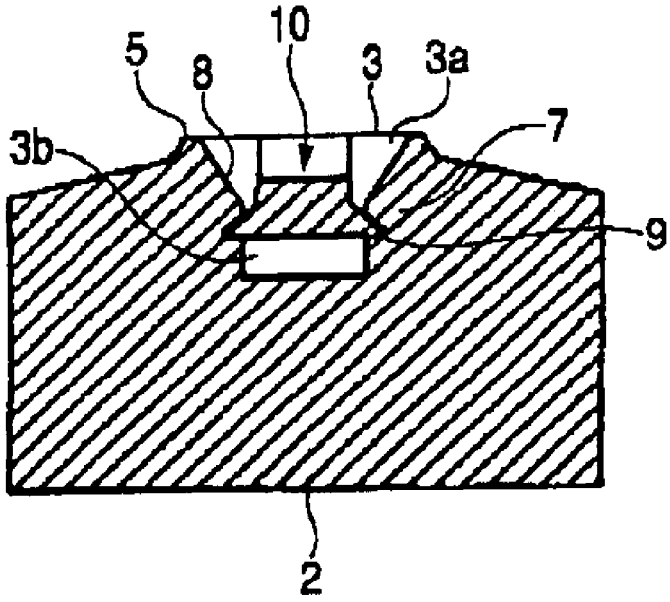
FIG. 29 is a sectional view taken along line 29—29 in FIG. 27.
Figure 30:
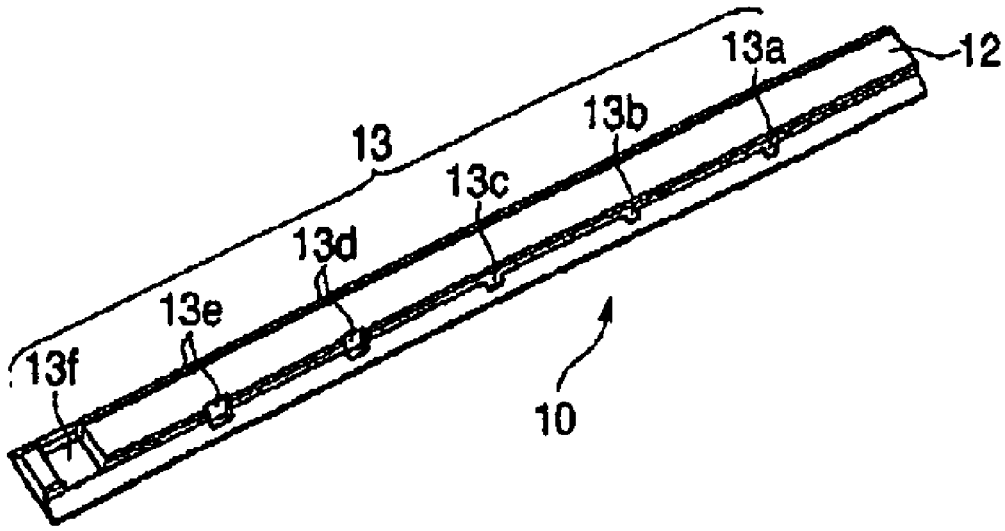
FIG. 30 is a perspective view showing an ink guide member.

In the state where the ink guide member 10 has been fitted to the cap member 2 and locked in the support portion 9, a suction channel 14 is defined between the lower surface of the ink guide member 10 and the cap member 2 as shown in FIGS. 28 and 29. The ink discharge port 4 is open to the suction channel 14 while the suction channel 14 communicates with the atmosphere through the plurality of communication holes 13. In this case, the distance between the lower surface of the ink guide member 10 and the bottom surface 6 which is inclined to the ink discharge port 4 so as to be lower in vertical direction toward the ink discharge port 4 is reduced in accordance with the distance from the ink discharge port 4. The ink guide member 10 is disposed horizontally.

Further, the opening of the ink discharge port 4 on the second concave portion 3*b* side is entirely covered with one longitudinal end portion of the ink guide member 10. In other words, the lower surface of the ink guide member 10 faces substantially all the area of the ink discharge port 4. In addition, of the communication holes 13, the hole 13*a* the closest to the ink discharge port 4 is formed in a position at a predetermined distance from the lower surface portion of the ink guide member 10 facing substantially all the area of the ink discharge port 4.

Incidentally, the bottom surface 6 of the cap member 2 is inclined like a straight line as shown in FIG. 16 or 28 in each of the aforementioned embodiments. The bottom surface 6 is not limited to this, but it may be inclined with its shape varied like a curved line. Alternatively, the bottom surface 6 may be inclined with its shape varied stepwise.

Although the pitch between adjacent ones of the communication holes 13 is made constant in the embodiments, the pitch between adjacent ones of the communication holes 13 may be set to be reduced in accordance with the distance from the ink discharge port 4.

Although the suction pump generates temporary negative pressure in the embodiments, a suction pump generating continuous negative pressure may be used.

Although each of the communication holes 13 of the ink guide member 10 is formed into a rectangular column-like shape having a rectangular section as shown in FIGS. 19A to 19D and FIGS. 31A and 31B, each communication hole 13 is not limited to this, but may be formed into, for example, a column-like or frustum-like shape having a circular section. In addition, although the largest hole 13*f* of the communication holes 13 is opened in the farthest position from the ink discharge part 4, the hole 13*f* may be formed out of a large number of small holes made intensively.

Figure 32A:
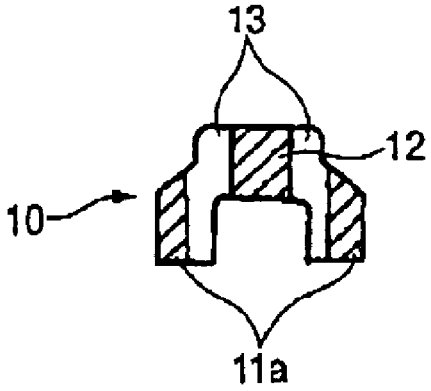
FIGS. 32A and 32B are sectional views each showing a configuration in which a part of a communication hole is formed in a rib.
Figure 32B:
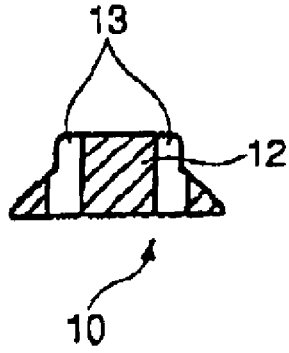

In each of the embodiments, the communication holes 13 of the ink guide member 10 are opened in the area where the top surface of the ink guide member 10 intersects the rib 12. However, each communication hole 13 may include the corner between the ink guide member 10 and the rib 12 so that a part of the communication hole 13 is formed in the rib 12, as shown in the sectional view of FIG. 32A or 32B.

Figure 33:
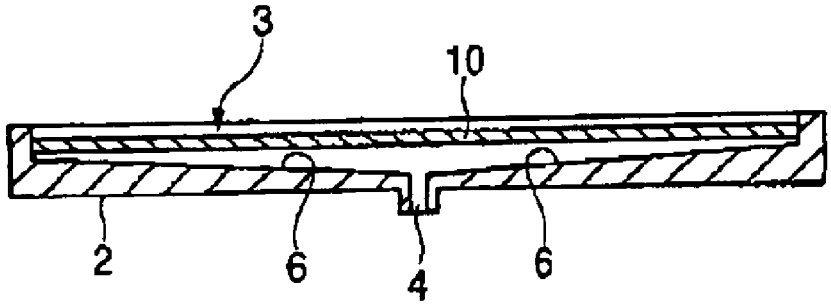
FIG. 33 is a longitudinal sectional view showing a modification of the cap.

In each of the embodiments, the ink discharge port 4 is formed in one longitudinal end of the bottom surface 6 which end is the lowest with respect to the vertical direction. For example, however, the case where the ink head has about two-fold length and hence the cap member 2 also has about two-fold length can be considered. In this case, as shown in FIG. 33, the ink discharge port 4 may be formed at the longitudinal center of the bottom surface which center is the lowest with respect to the vertical direction, while the bottom surface 6 on either side of the ink discharge port 4 is inclined to the ink discharge port 4. In this cases the ink guide member 10 also has about two-folded length and is disposed all over the length of the concave portion 3.

As was described above, according to the invention, it is possible to provide an inkjet recording apparatus having a cap configuration in which ink can be prevented from remaining in a cap without complicating the manufacturing process.

According to a first or seventeenth aspect of this embodiment, in comparison with a configuration having a constant ink channel, the ink channel 14 is so narrow in a position distant from the ink discharge port 4 that negative pressure on ink is generated satisfactorily. On the other hand, the ink channel 14 is so wide in a position close to the ink discharge port 4 that the ink in the position far from the ink discharge port 4 can reach the position close to the ink discharge port 4 and be discharged from the ink discharge port 4 smoothly. As a result, the amount of ink surviving in the cap member 2 can be reduced, and the ink can be sucked surely and efficiently.

In addition, according a second or ninth aspect of this embodiment, the face portion of the ink guide member faces substantially all the area of the ink discharge port 4 so that ink even in a position far from the ink discharge port 4 can be discharged from the ink discharge port 4 more surely than in the configuration in which the face portion faces only a part of the ink discharge port or does not face any part of the ink discharge port.

In addition, according a third aspect of this embodiment, advantages similar to that of first or second aspect can be obtained.

In addition, according to a fourth or eighth aspect of this embodiment, the flow of ink is made smooth by the communication holes 13 formed in the ink guide member 10 so that the ink can be sucked surely and efficiently.

In addition, according to a ninth aspect of this embodiment, the strength and rigidity of the ink guide member are enhanced by the rib 12 formed in the ink guide member 10.

In addition, according to a tenth aspect of this embodiment, ink can flow into the communication holes 13 smoothly due to the rib 12 formed in the ink guide member 10.

In addition, according to an eleventh aspect of this embodiment, the end portion of the ink guide member 10 near the ink discharge port 4 is formed along the ink discharge port 4 so that the flow of ink near the ink discharge port 4 can be made smooth.

In addition, according to a twelfth aspect of this embodiment, the flow of ink is made smooth due to the difference in wettability so that the ink can be sucked surely and efficiently.

In addition, according to a thirteenth aspect of this embodiment, the distance between the ink guide member 10 and the bottom surface of the sealing portion can be secured simply by the foot portions 11*a* of the ink guide member.

In addition, according to a fifteenth aspect of this embodiment, the distance between the ink guide member 10 and the bottom surface of the sealing portion can be secured simply by the support portion of the cap member 2.

Further, according to a fourteenth or sixteenth aspect of this embodiment, the distance can be obtained more simply so that the manufacturing can be made easier and the cost can be reduced.

The foregoing description of the preferred embodiments of the invention has been presented for purposes of illustration and description. It is not intended to be exhaustive or to limit the invention to the precise form disclosed, and modifications and variations are possible in light of the above teachings or may be acquired from practice of the invention. The embodiments were chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

What is claimed is:

1. An inkjet recording apparatus comprising:

a print head having a plurality of inkjet ports;

a suction cap which seals up the inkjet ports to carry out ink suction, the suction cap having an ink discharge port for discharging ink received through the ink suction; and an ink guide member which is engageable into the suction cap, the ink guide member having reinforcing rib on an upper surface thereof and a channel of predetermined length on a lower surface thereof;

wherein the channel constitutes a suction channel between the channel and the suction cap when the ink guide member is engaged into the suction cap, the suction channel communicating with the ink discharge port.

2. The inkjet recording apparatus according to claim 1, wherein the ink guide member has at least one communication hole for allowing the suction channel to communicate with atmosphere.

3. The inkjet recording apparatus according to claim 2, wherein the communication hole comprises a plurality of communication holes formed at predetermined intervals along a length direction of the channel, and a sectional area of each of the communication holes is set to increase in accordance with a distance from the ink discharge port.

4. The inkjet recording apparatus according to claim 3, wherein the ink guide member has a reinforcing rib provided in a width-direction central portion of a top surface thereof so as to extend lengthwise, and the communication hole comprises a plurality of communication holes formed at predetermined intervals along a length direction of the channel on opposite sides of the reinforcing rib.

5. The inkjet recording apparatus according to claim 2, wherein the communication hole comprises a plurality of communication holes formed at predetermined intervals along a length direction of the channel, and a pitch between adjacent ones of the communication holes is set to decrease in accordance with a distance from the ink discharge port.

6. The inkjet recording apparatus according to claim 5, wherein the ink guide member has a reinforcing rib provided in a width-direction central portion of a top surface thereof so as to extend lengthwise, and the communication hole comprises a plurality of communication holes formed at predetermined intervals along a length direction of the channel on opposite sides of the reinforcing rib.

7. The inkjet recording apparatus according to claim 2, wherein the ink guide member has a reinforcing rib provided in a width-direction central portion of a top surface thereof so as to extend lengthwise, and the communication hole comprises a plurality of communication holes formed at predetermined intervals along a length direction of the channel on opposite sides of the reinforcing rib.

8. The inkjet recording apparatus according to claim 1, further comprising:

a suction pump for generating negative pressure to suck ink from the suction cap; and a tube connecting the suction pump and the discharge port of the suction cap, wherein the suction pump sucks ink from the suction cap through the tube.

9. An inkjet recording apparatus comprising:

a print head having a plurality of inkjet ports;

a suction cap which seals up the inkjet ports to carry out ink suction, the suction cap having an ink discharge port for discharging ink received through the ink suction; and an ink guide member which is engageable into the suction cap, the ink guide member having a channel of predetermined length, wherein the channel constitutes a suction channel between the channel and the suction cap when the ink guide member is engaged into the suction cap, the suction channel communicating with the ink discharge port, and wherein the suction cap has a bottom surface, the ink guide member is engageable into the suction cap so as to be opposed to the bottom surface of the suction cap, and a distance between the bottom surface of the suction cap and the ink guide member is set to be larger in an area near the ink discharge port than in an area distant from the ink discharge port when the ink guide member is engaged into the suction cap.

10. The inkjet recording apparatus according to claim 9, wherein the ink guide member has a face portion that faces substantially entire area of the ink discharge port when the ink guide member is engaged into the suction cap.

11. The inkjet recording apparatus according to claim 10, wherein the ink guide member has at least one communication hole for allowing a space defined between the bottom surface of the suction cap and the ink guide member to communicate with atmosphere when the ink guide member is engaged into the suction cap, and the communication hole is formed in a position at a predetermined distance from the face portion of the ink guide member.

12. The inkjet recording apparatus according to claim 9, wherein the ink discharge port is formed in the bottom surface of the suction cap.

13. The inkjet recording apparatus according to claim 9, wherein the ink guide member has at least one communication hole for allowing a space defined between the bottom surface of the suction cap and the ink guide member to communicate with atmosphere when the ink guide member is engaged into the suction cap.

14. The inkjet recording apparatus according to claim 13, wherein the communication hole comprises a plurality of communication holes, and a sectional area of each of the communication holes is set to increase in accordance with a distance from the ink discharge port.

15. The inkjet recording apparatus according to claim 13, wherein the communication hole comprises a plurality of communication holes, and a sectional area of one of the communication holes the most distant from the ink discharge port is set to be the largest.

16. The inkjet recording apparatus according to claim 13, wherein the communication hole comprises a plurality of communication holes, and a pitch between adjacent ones of the communication holes is set to decrease in accordance with: a distance from the ink discharge port.

17. The inkjet recording apparatus according to claim 13, wherein a rib is provided in a width-direction central portion of a top surface of the ink guide member so as to extend in a predetermined direction, and the communication hole comprises a plurality of communication holes formed on opposite sides of the rib.

18. The inkjet recording apparatus according to claim 17, wherein the communication holes are formed in an area where the top surface and the rib intersect each other.

19. The inkjet recording apparatus according to claim 9, wherein an end portion of the ink guide member near the ink discharge port is formed into a shape in which vertical outer walls of the end portion extend along an edge of the ink discharge port.

20. The inkjet recording apparatus according to claim 9, wherein the ink guide member is made of a material whose wettability is higher than that of the cap member.

21. The inkjet recording apparatus according to claim 9, wherein the ink guide member has foot portions for defining the distance between the bottom surface of the suction cap and the ink guide member.

22. The inkjet recording apparatus according to claim 21, wherein the foot portions are molded integrally with the ink guide member.

23. The inkjet recording apparatus according to claim 9, wherein the suction cap has a support portion for defining the distance between the bottom surface of the suction cap and the ink guide member.

24. The inkjet recording apparatus according to claim 23, wherein the support portion is molded integrally with the suction cap.

25. The inkjet recording apparatus according to claim 9, wherein the distance between the bottom surface of the suction cap and the ink guide member is set to decrease in accordance with a distance from the ink discharge port.

26. A purge unit comprising;

a suction cap for sealing up inkjet ports of a print head, the suction cap having an ink discharge port for discharging ink received from the print head; and an ink guide member which is engageable into the suction cap, the ink guide member having a reinforcing rib on an upper surface thereof and a channel of predetermined length on a lower surface thereof; and a suction pump for sucking ink from the suction cap through a tube connected to the ink discharge port, wherein the channel constitutes a suction channel between the channel and the suction cap when the ink guide member is engaged into the suction cap, the suction channel communicating with the ink discharge port.

27. An ink guide member which is engageable into a suction cap that has an ink discharge port and seals up inkjet ports of a print head in an inkjet recording apparatus, the ink guide member comprising;

a reinforcing rib on an upper surface thereof; and a channel portion of predetermined length on a lower surface thereof, wherein the channel portion constitutes a suction channel between the ink guide member and the suction cap when the ink guide member is engaged into the suction cap, the suction channel communicating with the ink discharge port.

28. An inkjet recording apparatus comprising:

a recording head for jetting ink from ink nozzles to conduct recording on a recording medium;

a cap having a sealing portion for sealing up the ink nozzles and an ink discharge port for sucking and discharging ink received from the recording head by means of negative pressure, the sealing portion having a bottom surface; and an ink guide member which is placable in the sealing portion oppositely to the bottom surface of the sealing portion, wherein a distance between the bottom surface of the sealing portion and the ink guide member is set to be larger in an area near the ink discharge port than in an area distant from the ink discharge port when the ink guide member is placed in the cap.

* * * * *